US007341470B2

(12) United States Patent
Suzuki et al.

(10) Patent No.: US 7,341,470 B2
(45) Date of Patent: Mar. 11, 2008

(54) ELECTRICAL CONNECTOR FOR FLEXIBLE PRINTED CIRCUIT BOARDS

(75) Inventors: Masayuki Suzuki, Tokyo (JP); Yuki Nakano, Tokyo (JP)

(73) Assignee: DDK Ltd. (JP)

( * ) Notice: Subject to any disclaimer, the term of this patent is extended or adjusted under 35 U.S.C. 154(b) by 0 days.

(21) Appl. No.: 11/454,164

(22) Filed: Jun. 14, 2006

(65) Prior Publication Data

US 2006/0281353 A1 Dec. 14, 2006

(30) Foreign Application Priority Data

Jun. 14, 2005 (JP) ..... 2005-173431

(51) Int. Cl.
*H01R 13/15* (2006.01)

(52) U.S. Cl. ..... 439/260

(58) Field of Classification Search ..... 439/260, 439/79, 495, 267

See application file for complete search history.

(56) References Cited

U.S. PATENT DOCUMENTS 5,702,271 A * 12/1997 Steinman ..... 439/676
6,319,030 B1 * 11/2001 Wu ..... 439/188
6,325,653 B1 * 12/2001 Takahashi ..... 439/260
7,074,054 B2 * 7/2006 Mertz et al. ..... 439/78

FOREIGN PATENT DOCUMENTS

| | | |
|---|---|---|
| JP | 1999-307198 | 5/1999 |
| JP | 2000-106238 | 4/2000 |
| JP | 2003-297489 | 10/2003 |
| JP | 2004-71160 | 4/2004 |
| JP | 2004-233197 | 8/2004 |

* cited by examiner

*Primary Examiner*—Neil Abrams
*Assistant Examiner*—Phuongchi Nguyen
(74) *Attorney, Agent, or Firm*—Baker Botts L.L.P.

(57) ABSTRACT

A connector includes a plurality of contacts having at least one contact portion adapted to contact a connecting object, a housing arranging and holding the contacts and having a fitting opening into which the connecting object is inserted, and a member for bringing the connecting object into contact with the contact portions of the contacts. The contacts are arranged orthogonally to the inserting direction of the fitting opening of the housing so that connection portions of the contacts extend onto either or both sides of the housing in its width direction, and after the connecting object has been inserted into the fitting opening, the member is inserted or pivotally moved to bring the connecting object into contact with the contact portions of the contacts. This connector completely complies with customer's requirements and overcomes the problems of mounting space on a substrate, operationality and reduced overall height.

25 Claims, 9 Drawing Sheets

ELECTRICAL CONNECTOR FOR FLEXIBLE PRINTED CIRCUIT BOARDS

CROSS-REFERENCE TO RELATED APPLICATIONS

This application claims priority from Japanese Patent Application No. 2005-173,431, filed Jun. 14, 2005, which is herein incorporated by reference in its entirety.

BACKGROUND OF THE INVENTION

The present invention relates to a connector for use in electric and electronic appliances such as mobile appliances and the like, and more particularly to a connector superior in stable electrical connection with a connecting object such as a flexible printed circuit board or flexible flat cable and capable of being mounted on one surface of a substrate to achieve simplification of connector mounting.

Connectors for use in mobile phones, CCD cameras (charge coupled device cameras) and the like are very thin in overall height and have extremely narrow pitches (so-called lighter and more compact). These connectors each mainly comprise a housing, contacts and a slider to embrace a flexible printed circuit board or flexible flat cable between the housing and the slider. Various methods may be considered for holding a circuit board or flat cable by the housing and the slider. There have been constructions used in many cases that after a flexible printed circuit board or flat cable has been inserted into the housing, the slider is inserted into the housing to press the circuit board or cable against the contacts.

In recent years, moreover, connectors using a pivoting member instead of the slider are increasingly being used to bring contacts into contact with a connecting object such as a flexible printed circuit board. In one type of these connectors, a pivoting member is pivotally moved on the side of insertion of a connecting object (front pivoting type), and in the other type, a pivoting member is pivotally moved on the opposite side of insertion of a connecting object (rear pivoting type).

The connector of the front pivoting type has been disclosed in Japanese Patent Application Opened No. 2000-106,238 (Patent Literature 1). The connectors of the rear pivoting type have been disclosed in Japanese Patent Application Opened No. 2003-297,489 (Patent Literature 2), Japanese Patent Application Opened No. H11-307,198/1999 (Patent Literature 3), and Japanese Patent Application Opened No. 2004-71,160 (Patent Literature 4). Moreover, the applicant of the present application has proposed a connector of the rear pivoting type in Japanese Patent Application No. 2004-233,197 (Patent Literature 5).

Patent Literature 1

According to the Abstract of the Japanese Patent Application Opened No. 2000-106,238, this invention has an object to provide a connector for a cable, which requires only a slight operating force even if there are many conductors of the cable. Disclosed in the Patent Literature 1 is a connector for a cable comprising contacts each having a contact portion facing to one surface of a cable and a pivot portion facing to the rear surface of the cable, and an actuating element adapted to press the cable against the contact portions of the contacts and having cam portions positioned between the pivot portions and the cable and holes into which the pivot portions are inserted with clearances, the pivot portions each having a recess corresponding to the cam portion so that the actuating element is adapted to engage the pivot portions in a manner that the actuating element is pivotally movable about the cam portions.

By the way, claim 1 of the Japanese Patent Application Opened No. 2000-106,238 recites that in a connector including contacts each having a contact portion facing to one surface of said cable and a pivot portion facing to the opposite surface of the cable, an insulator for holding said contacts, and an actuating element for pressing the cable against the contact portions of said contacts, said actuating element includes cam portions positioned between the pivot portions and the cable and holes into which said pivot portions are inserted with clearances, respectively, and said pivot portions each having a recess corresponding to said cam portion so that said actuating element is adapted to engage the pivot portions in a manner that the actuating element is pivotally movable about the cam portions. Claim 2 recites that said insulator includes anchoring portions adapted to engage said actuating element to hold said actuating element and said cam portions are spaced apart from said contact portions of the contacts when the cable has not been connected to the connector. Claim 3 recites that said cable is a flat cable, and said insulator includes cable anchoring grooves for receiving side edges of the cable to prevent the cable from moving in the direction of its thickness when the cable has been connected to the connector. Claim 4 recites that in a connector obtaining electrical connection between contacts and a cable in a manner that one surface of the cable faces to the contact portions of the contacts and the opposite surface of the cable is urged against the contact portions by the rotational actuating element, said contact portions each provided with at least two contact side projections, while said actuating element is provided with actuating element side projections corresponding to spaces between said contact side projections. Claim 5 recites the connector including said contacts each having a pivot portion facing to the opposite surface of the cable and said actuating element having cam portions between the pivot portions and the cable, said cam portions each provided with said actuating element side projection.

"Patent Literature 2"

According to the Abstract of the Japanese Patent Application Opened No. 2003-297,489, this invention has an object to provide a connector of reduced overall height including an actuator to be operated by only a slight operating force and enabling contacts to move large distances to perform reliable connection of the contacts. The actuator includes cam portions and an actuating portion, and the actuator is formed between the cam portions and the actuating portion with relief grooves into and from which tips of spring portions of the contacts are inserted and removed. When the actuator is rotated clockwise about its fulcrum point through 90 degrees, the cam portions cause the spring portions and connection spring portions to be elastically deformed, thereby embracing a flexible circuit board between projections of the contact portions of the contacts to achieve electrical connection between patterns of the circuit board and a printed board through terminals of the contacts. A ceiling portion of an insulator covers the contact portions of the contacts, and the lower portion under the ceiling portion on the front side is formed with a guide for inserting the circuit board into the connector.

By the way, the claim 1 of the Japanese Patent Application Opened No. 2003-297,489 recites that in a connector including contacts, an insulator for holding the contacts, and an actuator rotatably mounted on the insulator and causing the contacts to be elastically deformed to bring them into contact with a connecting object, the contacts each comprise a first beam having a contact portion at its one end adapted to contact the connecting object and an actuated portion at the other end adapted to be actuated by the actuator, a second beam having a contact portion at its one end adapted to contact the connecting object and a terminal at the other end to be connected to a printed substrate, and a connecting spring for connecting the first and second beams, and said insulator has a ceiling portion for covering at least the contact portions of the contacts on the fitting side and said ceiling portion formed with a guide for guiding the insertion of the connecting object. Claim 2 recites a connector of the contacts each of which has at least one contact portion having in the proximity of the connecting spring an inclined portion inclining toward the connecting object. Claim 3 recites a connector of the actuator having an actuating portion, cam portions for actuating the actuated portions of the contacts, and relief groves positioned between the actuating portion and the cam portions so that in the state that the connecting object is not connected to the connector, the actuated portions can be inserted into the relief grooves. Claim 4 recites that in a connector including contacts, an insulator holding the contacts, and an actuator rotatably mounted on the insulator and causing the contacts to be elastically deformed to bring them into contact with a connecting object, said contacts each comprise a first beam having a contact portion at its one end adapted to contact the connecting object and an actuated portion at the other end adapted to be actuated by the actuator, a second beam having a contact portion at its one end adapted to contact the connecting object and a terminal at the other end to be connected to a printed substrate, and a connecting spring for connecting the first and second beams, said contact portion of the first beam having a first projection and a second projection extending toward the connecting object and arranged side by side in the inserting direction of the connecting object, and said contact portion of the second beam having a third projection and a fourth projection extending toward the connecting object and arranged side by side in the inserting direction of the connecting object, so that depending upon the third projection being positioned between the first and second projections or the first projection being positioned between the third and fourth projections, the first and second projections or the third and fourth projections come into contact with the connecting object.

"Patent Literature 3"

According to the Abstract of Japanese Patent Application Opened No. H11-307,198/1999, this invention has an object to improve operationality and holding power of a connector connecting a plurality of terminals and holding a flexible printed circuit board and the like. The disclosed connector for a printed circuit board includes a housing formed with inserting groove for inserting the flexible printed circuit board, a plurality of contacts provided side by side whose contact portions are arranged to extend and retract relative to the inserting groove, and an actuating member arranged pivotally movably between a connecting and a disconnecting position. The actuating member is provided with a plurality of cams so that when the actuating member is in the connecting position, contacts are urged with their actuated portions by the cams to extend their contact portions into the inserting groove thereby enabling the contact portions to be pressed against and connected to terminals of the flexible printed circuit board and holding the circuit board. On the other hand, when the actuating member is in the disconnecting position, some contacts are urged with their actuated portions by the cams to slightly extend their contact portions into the inserting groove so as to abut against the flexible printed circuit board or the like, thereby temporarily holding the circuit board, while the contact portions of the remaining contacts are retracted from the inserting groove.

By the way, claim 1 of the Japanese Patent Application Opened No. H11-307,198/1999 recites that in a connector for a printed circuit board, provided with a plurality of contacts arranged side by side for connecting a plurality of terminals of a printed circuit board or the like in the lump, said connector comprises a housing having an inserting groove for inserting the printed circuit board or the like, said contacts arranged to extend and retract relative to said inserting groove, and an actuating member provided movably between a connecting and a disconnecting position, and when the actuating member is in the connecting position, the contacts are urged by the actuating member so as to extend into the inserting groove to press the terminals of the flexible printed circuit board or the like so that the contacts are connected to the terminals and hold the printed circuit board or the like, and when the actuating member is in the disconnecting position, some of the contacts extend slightly into the inserting groove to abut against and temporarily hold the printed circuit board or the like, and the remaining contacts retract relative to the inserting groove. Claim 2 recites a connector for a printed circuit board in that the plurality of the contacts are formed in the same shape and the actuating member is provided with a plurality of cams, and when the actuating member is in the connecting position, the contacts are urged by the cams to extend into the inserting groove, and when the actuating member is in the disconnecting position, the some contacts are urged by the cams to slightly extend into the inserting groove and the remaining contacts are retracted relative to the inserting groove.

"Patent Literature 4"

According to the Abstract of the Japanese Patent Application Opened No. 2004-71,160, this invention has an object to provide a connector capable of securely urging a flexible printed circuit board or flexible flat cable to contact portions of contacts by means of a slider without degrading strength of respective members and specifications or customers demands, and achieving a superior operationality, narrower pitches of conductors and reduced overall height. This connector comprises contacts each comprising a contact portion, a connection portion, and an elastic portion and a fulcrum portion between the contact portion and the connection portion, and a pressure receiving portion extending from the elastic portion in a position facing to the connection portion, and the contact portion, elastic portion, fulcrum portion and connection portion being arranged in the form of a crank, and a slider comprising urging portions arranged continuously in the longitudinal direction and pivotally mounted on a housing so that the urging portions are pivotally moved in a space between the connection portions and pressure receiving portions of the contacts.

Claim 1 of the Japanese Patent Application Opened No. 2004-71,160 recites a connector removably fitted with a flexible printed circuit board or flexible flat cable, including a required number of contacts having a contact portion adapted to contact said flexible printed circuit board or flexible flat cable, a housing holding and fixing the contacts and having a fitting opening for inserting the flexible printed circuit board or flexible flat cable, and a slider for urging the flexible printed circuit board or flexible flat cable to the contacts, wherein the contacts each comprise an elastic portion and a fulcrum portion between the contact portion and a connection portion, and a pressure receiving portion extending from the elastic portion and located in a position facing to the connection portion, and the contact portion, elastic portion, fulcrum portion and connection portion being arranged substantially in the form of a crank, and the slider is provided with urging portions continuously arranged in its longitudinal direction and is mounted on the housing so that the urging portions are pivotally moved in a space between the connection portions and pressure receiving portions of the contacts. Claim 2 recites a connector removably fitted with a flexible printed circuit board or flexible flat cable, including a required number of contacts having a contact portion adapted to contact said flexible printed circuit board or flexible flat cable, a housing holding and fixing the contacts and having a fitting opening for inserting the flexible printed circuit board or flexible flat cable, and a slider for urging the flexible printed circuit board or flexible flat cable to the contacts, wherein two kinds of contacts are arranged alternately staggered, the contacts of one kind each comprising an elastic portion and a fulcrum portion between the contact portion and a connection portion, and a pressure receiving portion extending from the elastic portion in a position facing to the connection portion, and the contact portion, elastic portion, fulcrum portion and connection portion being arranged substantially in the form of a crank, and the contacts of the other kind each comprising an elastic portion and a fulcrum portion between the contact portion and a connection portion, and a pressure receiving portion extending in the opposite direction of the contact portion, and the contact portion, elastic portion, fulcrum portion, and connection portion being arranged substantially in the form of a U-shape, and the slider is provided with urging portions arranged continuously in its longitudinal direction and mounted on the housing so that the urging portions are pivotally moved in a space between the connection portions and the pressure receiving portions of the contacts of the one kind and between the pressure receiving portions of the contacts of the other kind and the housing. Claim 3 recites that when the urging portions of the slider are pivotally moved in the space between the connection portions and the pressure receiving portions of the contacts of the one kind, the pressure receiving portions are raised by the urging portions so that the elastic portions are tilted about the fulcrum portions toward the contact portions to urge the contact portions against the flexible printed circuit board or flexible flat cable. Claim 4 recites that the pressure receiving portions of the contacts of the one kind or the other kind are each provided with a projection so that the urging portions of the slider are prevented from moving toward the connection portions of the contacts of the one kind. Claim 5 recites that the urging portions of the slider are of an elongated shape. Claim 6 recites that the slider is formed with a required number of anchoring holes independent from one another, which are adapted to engage the projections of the contacts, respectively. Claim 7 recites the elongated urging portions being in the form of an ellipsoid. Claim 8 recites a connector of contacts each provided with a further contact portion at a location extending from the fulcrum portion and adapted to contact the flexible printed circuit board or flexible flat cable. Claim 9 recites that the contacts of the other kind are each provided with an extension portion extending from the fulcrum in the opposite direction of the connection portion, and the slider is mounted on the housing so that the urging portions of the slider are pivotally moved in the space between the extension portions and the pressure receiving portions. Claim 10 recites a connector of the contacts of the other kind each provided between the fulcrum portion and the connection portion with a contact portion adapted to contact the flexible printed circuit board or flexible flat cable.

"Patent Literature 5"

According to the Abstract of the Japanese Patent Application No. 2004-233,197, this invention has an object to provide a connector which achieves a miniaturization or reduced overall height, and a stable electrical connection with simple operation and slight operating force without any failed connection even if a connecting object is subjected to undue external force. Disclosed is the connector comprising contacts each including a first piece having a contact portion at one end adapted to contact the connecting object, a pressure receiving portion at the other end to be urged by the pivoting member, and a projection inwardly extending from the tip of the pressure receiving portion, a second piece having at one end a connection portion to be connected to a substrate and at the other end a fulcrum portion, and an elastic portion for connecting the first piece and the fulcrum portion, and the contact portion, elastic portion, fulcrum portion and connection portion being arranged in the form of a crank; a housing formed with protection walls at least at both the ends for preventing its ceiling portion from being raised when the connecting object is subjected to accidental external force upward; and a pivoting member including a actuating portion, urging portions, projections and anchoring holes so that when the urging portions are pivotally moved, the axis of rotation is moved with the pivotal movement to achieve their compact rotation.

Incidentally, Claim 1 of the Japanese Patent Application No. 2004-233,197 recites a connector including a plurality of contacts having at least one contact portion adapted to contact a connecting object, a housing arranging and holding said contacts and having a fitting opening into which said connecting object is inserted, and a pivoting member for causing said contacts to be elastically deformed to urge said contacts against said connecting object, wherein said contacts each comprise a first piece having the contact portion at one end adapted to contact said connecting object, a pressure receiving portion at the other end adapted to be urged by said pivoting member, and a projection inwardly extending from the tip of said pressure receiving portion; a second piece having a fulcrum portion at one end and a connection portion at the other end adapted to be connected to a board; and an elastic portion for connecting said first piece and said fulcrum portion; and said contact portion, said elastic portion, said fulcrum portion and said connection portion being arranged substantially in the form of a crank, wherein said housing includes a ceiling portion for covering said contact portions of the contacts, said ceiling portion being formed at least on both the ends with protection walls for preventing said ceiling portion from being raised when said connecting object is accidentally subjected to undue external force upward, and wherein said pivoting member includes an actuating portion for pivotally moving said pivoting member, urging portions continuously arranged in the longitudinal direction of the pivoting member, and anchoring grooves independent from one another for receiving therein said pressure receiving portions and adapted to engage said projections, respectively, and said pivoting member is mounted on said housing so that the urging portions are pivotally moved between the connection portions and the pressure receiving portions of the contacts, and the rotational axis of said urging portions is moved with their pivotal movement to achieve their compact rotation. Claim 2 recites a connector including a plurality of contacts having at least one contact portion adapted to contact a connecting object, a housing arranging and holding said contacts and having a fitting opening into which said connecting object is inserted, and a pivoting member for causing said contacts to be elastically deformed to urge said contacts against said connecting object, wherein said contacts consist of two kinds of contacts arranged alternately staggered, said contacts of the one kind each comprising a first piece having the contact portion at one end adapted to contact said connecting object and a pressure receiving portion at the other end adapted to be urged by said pivoting member; a second piece having a fulcrum portion at one end and a connection portion at the other end adapted to be connected to a board; and an elastic portion for connecting said first piece and said fulcrum portion; and said contact portion, said elastic portion, said fulcrum portion and said connection portion being arranged substantially in the form of a crank, and said contacts of the other kind each comprising a first piece having the contact portion at one end adapted to contact said connecting object and a pressure receiving portion at the other end adapted to be urged by said pivoting member; a second piece having a connection portion at one end adapted to be connected to a board and a fulcrum portion at the other end; and an elastic portion for connecting said first piece and said fulcrum portion; and said contact portion, said elastic portion, said fulcrum portion and said connection portion being arranged substantially in the form of a U-shape, and said pressure receiving portions of the contacts of at least either the one kind or the other kind being each provided at the tip with an inwardly extending projection, wherein said housing includes a ceiling portion for covering said contact portions of the contacts, said ceiling portion being formed at least on both the ends with protection walls for preventing said ceiling portion from being raised when said connecting object is accidentally subjected to undue external force upward, and wherein said pivoting member includes an actuating portion for pivotally moving said pivoting member, urging portions continuously arranged in the longitudinal direction of the pivoting member, and anchoring grooves independent from one another for receiving therein said pressure receiving portions and adapted to engage said projections, respectively, and said pivoting member is mounted on said housing so that the urging portions are pivotally moved between the connection portions and the pressure receiving portions of the contacts of the one kind and between the pressure receiving portions of the contacts of the other kind and the housing, and the rotational axis of said urging portions is moved with their pivotal movement to achieve their compact rotation. Claim 3 recites that when the connecting object is connected to the connector, the urging portions of the pivoting member are positioned such that before connecting said connecting object to said connector, the lower ends of said urging portions are positioned between the projections of said pressure receiving portions and the connection portions and the housing or extension portions, that second on pivotally moving said actuating portion of the pivoting member, said urging portions are moved in a direction opposite to said fitting opening so that the lower ends of said urging portions are embraced between the projections of said pressure receiving portions and the connection portions and the housing or extension portions, that third on further pivotally moving said actuating portion of the pivoting member, said urging portions at their second position are pivotally moved about the center of said urging portions as their rotational axis, that fourth on further pivotally moving said actuating portion of the pivoting member, said urging portions at their third position are pivotally moved about the center of said urging portions as their rotational axis so that said urging portions stand substantially upright between said pressure receiving portions and said connection portions and the housing or the extension portions, and the rotational axis is moved toward the upper ends of said urging portions in contact with said projections, and that finally on further pivotally moving said actuating portion of the pivoting member, said urging portions at their fourth position are pivotally moved about a center in the proximity of the upper ends of said urging portions in contact with said projections to cause said urging portions to engage said projections. Claim 4 recites that said ceiling portion is further provided with a protection wall substantially at its center for preventing said ceiling portion from being raised when the connecting object is accidentally subjected to undue external force upward. Claim 5 recites that said contacts and said contacts of the one kind are each provided with an extension portion extending from the fulcrum portion in such a direction that said extension portion faces to said contact portion. Claim 6 recites that said contacts of the other kind are each provided with an extension portion extending from the fulcrum portion in such a direction that said extension portion faces to said pressure receiving portion, and said pivoting member is mounted on the housing so that said urging portions of the pivoting member are pivotally moved between said extension portions and said pressure receiving portions. Claim 7 recites that a further contact portion adapted to contact the connecting object is provided on said extension portion of each of said contacts and said contacts of the one kind, and a further contact portion adapted to contact the connecting object is also provided between said fulcrum portion and the connection portion of each of said contacts of the other kind. Claim 8 recites that said housing is provided with recessed portions on the side of the fitting opening for conducting a connecting object, and the contacts of the other kind are so arranged that the connection portions of the contacts do not extend from said recessed portions. Claim 9 recites that the connecting object is provided with anchoring portions, and there are provided locking members each having an engaging portion adapted to engage said anchoring portion and said locking means are substantially the same in construction as that of said contacts, said contacts of the one kind or said contacts of the other kind. Claim 10 recites that said further contact portion provided on said extension portion of each of said contacts and said contacts of the one kind is constructed to have elasticity, and said further contact portion provided between the fulcrum portion and the connection portion of each of said contacts of the other kind is constructed to have elasticity. Claim 11 recites that the housing is provided with anchoring portions at locations corresponding to the connection portions of said contacts or said contacts of the one kind, while the connection portions of said contacts and said contacts of the one kind are each provided with an inclined engaging portion adapted to engage said anchoring portion, and said extension portions of said contacts and said contacts of the one kind are not held by the housing. Claim 12 recites that when inserting said contact or said contact of the one kind into said housing from the opposite side of said fitting opening, at the commencement of the engagement of the anchoring portion with the engaging portion, the contact portion of the contact is substantially in parallel with an inserting hole of the housing, and on proceeding of the insertion the contact is obliquely inclined so that the contact portion of the contact comes into contact with the upper wall of the inserting hole, and wherein when the insertion of the contact has been completed, the contact portion has returned in parallel with the inserting hole with the aid of said inclined engaging portion.

Various types of connectors have advantages and disadvantages, respectively. For example, the connectors of the front lock type or front pivoting type described above may be possible to achieve a miniaturization and narrower pitches of connectors and minimization of space (of the order of 3 mm) in a depth direction, but it is difficult to achieve reduced overall height (approximately 1 mm at best), the compliance with a requirement for contacts arranged on upper and lower sides according to specifications, sufficient connecting stability and holding forces when a connecting object is accidentally subjected to an external force upwardly, and smooth guidance of a connecting object. In the connectors of the back lock type or rear pivoting type, moreover, it has advantages of achieving the miniaturization and narrower pitches of connectors, reduced overall height (of the order of 0.65 mm), the compliance with the requirement for contacts arranged on upper and lower sides according to specifications, the improved connecting stability and holding forces when a connecting object is accidentally subjected to an external force upwardly, and easy guidance of a connecting object. However, they suffer a disadvantage from a limited minimization of space in the depth direction as the order of 3.5 mm at best.

In the above connectors disclosed in the Patent Literatures 1 to 5, the pivoting member is pivotally moved on the side of the fitting side or the opposite side from the fitting side and on the connector mounting side to bring the contacts into contact with a connecting object such as a flexible printed circuit board or the like, and the connector is mounted onto the upper or lower surface of a substrate in either case. There have been needs for extending connection portions of contacts orthogonally to the direction of the fitting opening owing to customer's specifications and mounting space on a substrate, and a further need for performing the operation for bringing the connecting object into contact with the contacts on the opposite side from the connector mounting side owing to customers specifications, mounting space on a substrate, and operationality.

Even with these connectors disclosed in the Patent Literatures 1 to 5, the connector is frequently mounted onto a substrate on its side surface depending on customer's specifications or owing to limitation of mounting space on the substrate. With the connectors of the Literatures 1 to 5, however, in the case that parts are mounted only one surface of a substrate according to a customer's specification, it would be impossible to achieve a reduced overall height (height of mounted connector) of not more than 0.9 mm and, in addition, operation of the pivoting member would become difficult.

Moreover, the connectors disclosed in the Patent Literatures 1 to 5 suffer a disadvantage from poor holding forces for connectors so that they would be dislodged from the substrate when a connecting object such as a flexible printed circuit board is subjected to an accidental external force. Further, a customer has requested that a dimension in a depth direction be within 3 mm, when a connector is mounted on a substrate.

SUMMARY OF THE INVENTION

It is an object of the invention to provide a connector which eliminates all the disadvantages of the prior art as described above and which can fully comply with the requirements of customers and overcome the problems of mounting spaces of substrates, operationality, reduced overall height and the like.

The above object can be achieved by the connector 10 according to the invention including a plurality of contacts 14, 16 having at least one contact portion 28 adapted to contact a connecting object, a housing 12 arranging and holding the contacts 14, 16 and having a fitting opening 20 into which the connecting object is inserted, and a member for bringing the connecting object into contact with the contact portions 28 of the contacts 14, 16, wherein the contacts 14, 16 are arranged orthogonally to the inserting direction of the fitting opening 20 of the housing 12 so that connection portions 32 of the contacts 14, 16 extend onto either or both sides of the housing 12 in its width direction, and after the connecting object has been inserted into the fitting opening 20, the member is inserted or pivotally moved to bring the connecting object into contact with the contact portions 28 of the contacts 14, 16.

A slider or a pivoting member 18 is used as the member, and after the connecting object has been inserted into the fitting opening 20, the slider is inserted or the pivoting member 18 is pivotally moved to bring the connecting object into contact with the contact portions 28 of the contacts 14, 16.

Moreover, the pivoting member 18 at least comprises an actuating portion 42 for pivotally moving the pivoting member, urging portions 44 causing the contacts 14, 16 to be elastically deformed, and anchoring holes 46 independent from one another each into which part of the contact 14, 16 can be inserted, and the pivoting member 18 is arranged correspondingly to arrangement of the contacts 14, 16 so that the contact portions 28 of the contacts 14, 16 are brought into contact with the connecting object by pivotally moving the pivoting member 18 on the same side as or opposite side from the connector mounted side of a substrate.

Furthermore, two the pivoting members 18 are arranged so as to face to each other in the width direction, and by pivotally moving the actuating portions 42 of the pivoting members 18 on the opposite side from the connector mounted side of the substrate, the contact portions 28 of the contacts 14, 16 are brought into contact with the connecting object.

When the connector is mounted on a side surface of the substrate 80, the substrate 80 is provided with a notch 82 so that the connector 10 is fitted in the notch 82 of the substrate. Moreover, the contacts 14, 16 are substantially H-shaped, and the substrate 80 is provided with the notch 82 having a depth of 3 mm or less, into which the connector 10 is fitted.

Further, the contacts 14, 16 each comprise a first piece 24 having a contact portion 28 adapted to contact the connecting object at one end and a pressure receiving portion 30 adapted to be urged by the pivoting member 18 at the other end, a second piece 26 having a further contact portion 28 adapted to contact the connecting object at one end and a connection portion 32 adapted to be connected to the substrate 80 at the other end, and a jointing portion 34 for connecting the first and second pieces 24 and 26, and holding means permitting the urging portion 44 of the pivoting member 18 to pivotally move between the pressure receiving portion 30 and the second piece 26 facing thereto, wherein the pivoting member 18 comprises an actuating portion 42 for pivotally moving the pivoting member, urging portions 44 arranged continuously in a longitudinal direction and causing the contacts 14, 16 to be elastically deformed, and anchoring holes 46 independent from one another each into which part of the pressure receiving portion 30 can be inserted, and the pivoting member 18 is mounted on the housing 12 so that the urging portions 44 are pivotally moved between the pressure receiving portions 30 and the second pieces 26 facing thereto of the contacts 14, 16, and wherein when the urging portions 44 are pivotally moved, a rotational axis of the urging portions is moved with their pivotal movement to perform a compact rotation, and when the actuating portion 42 is pivotally moved in a direction at right angles to the direction of the fitting opening 20 of the housing 12 and away from the connection portions 32 of the contacts 14, 16 so that the contact portions 28 of the contacts 14, 16 are brought into contact with the connecting object.

As the holding means, at least every other contact 14, 16 is provided on the second piece 26 with a raised portion 40 extending toward the pressure receiving portion 30, while the pressure receiving portion 30 of the first piece 24 is provided with a protruded portion 38 extending toward the raised portion 40 so that the protruded portions 38 and the raised portions 40 are staggered relative to each other, thereby holding the urging portions 44 of the pivoting member 18 to permit their pivotal movement.

As the holding means, at least every other contact 14, 16 is provided with a protrusion 41 extending toward the pressure receiving portion 30 between the raised portion 40 of the second piece 26 and the jointing portion 34.

Moreover, the contacts 14, 16 provided with protruded portion 38 and the raised portion 40 and the contacts 14, 16 provided with the protrusion 41 are staggered relative to each other. Further, the contacts 14, 16 are each provided with a projection at the tip of the pressure receiving portion 30 of the first piece 24. The protruded portion 38, the raised portion 40 and the protrusion 41 are arranged substantially at apexes of a triangle.

When the connecting object is connected to the connector 10, the urging portions 44 of the pivoting member 18 are positioned such that before connecting the connecting object to the connector 10, the lower ends 68 of the urging portions 44 of the pivoting member 18 are in a state contacting the protrusions 41, that second on pivotally moving the actuating portion 42, lower ends 68 of the urging portions 44 in contact with the protrusions 41 are pivotally moved about a center of rounded shape of the lower ends 68 as a rotational axis 64 so that the urging portions 44 comes into a slightly inclined state, that third on further pivotally moving the actuating portion 42 the lower ends 68 are somewhat moved from the second state toward the connection portions 32 and pivotally moved about the center of the urging portions 44 as a rotational axis 64 so that the urging portions 44 come into a substantially vertical state, that fourth on further pivotally moving the actuating portion 42, the lower ends 68 are further moved from the third state toward the connection portions 32 and upper ends 66 of the urging portions 44 move toward the protruded portions 38 so that the urging portions 44 come into a vertical state, that fifth on further pivotally moving the actuating portion 42, the lower ends 68 are further moved from the fourth state toward the connection portions 32 and the upper ends 66 of the urging portions 44 come into a state contacting with the protruded portions 38, and that finally on further pivotally moving the actuating portion 42 from the fifth state, the urging portions 44 are pivotally moved about a center of rounded shape of the upper ends 66 as a rotational axis 64 so that the contact portions 28 of the contacts 14, 16 are brought into contact with the connecting object by pivotally moving the pivoting member 18 toward the direction of the fitting opening 20 of the housing 12, and clearances are provided between axles of the pivoting member 18 and bearing portions of the housing 12, thereby enabling a compact rotation of the urging portions of the pivoting member. Further, the connection portions 32 or the contact portions 28 of the contacts 14, 16 are staggered relative to each other.

The functions of the connector according to the invention are as follows. After a connecting object such as a flexible printed circuit board 70 or flexible flat cable has been inserted into the fitting opening 20 of the housing 12, when the member is inserted or rotated, the contact portions 28 of the contacts 14, 16 are brought into contact with the connecting object. For example, in the case that the pivoting member 18 is used as the member, after the connecting object such as the flexible printed circuit board 70 or flexible flat cable has been inserted into said fitting opening 20 of the housing 12, when the urging portions 44 of the pivoting member 18 are pivotally moved between the pressure receiving portions 30 and the second pieces 26 facing thereto of the contacts 14, 16, the pressure receiving portions 30 are raised upwardly by the urging portions 44 so that the jointing portions 34 of the contacts 14, 16 are tilted toward said contact portions 28 about the jointing portions 34 of the contacts 14, 16 as fulcrums, thereby pressing said contact portions 28 against the connecting object such as the flexible printed circuit board or flexible flat cable.

As can be seen from the above description, the connector according to the invention can bring about the following significant functions and effects. (1) A connector 10 includes a plurality of contacts 14, 16 having at least one contact portion 28 adapted to contact a connecting object, a housing 12 arranging and holding the contacts 14, 16 and having a fitting opening 20 into which the connecting object is inserted, and a member for bringing the connecting object into contact with said contact portions 28 of the contacts 14, 16, according to the invention the contacts 14, 16 are arranged orthogonally to the inserting direction of the fitting opening 20 of the housing 12 so that connection portions 32 of the contacts 14, 16 extend onto either or both sides of the housing 12 in its width direction, and after the connecting object has been inserted into the fitting opening 20, the member is inserted or pivotally moved to bring the connecting object into contact with said contact portions 28 of the contacts 14, 16. Therefore, the connector according to the invention can accommodate the mounting space on the substrate imposed by a customer's requirement and minimize the occupied area of the substrate (particularly, less than 3 mm in a depth direction) and is simple to operate.

(2) According to the invention a slider or a pivoting member 18 is used as the member, and after the connecting object has been inserted into the fitting opening 20, said slider is inserted or the pivoting member 18 is pivotally moved to bring the connecting object into contact with the contact portions 28 of the contacts 14, 16. Therefore, the connector according to the invention can minimize the occupied area of the substrate (particularly, less than 3 mm in a depth direction), and the member or the pivoting member is simple to operate.

(3) According to the invention, the pivoting member 18 at least comprises an actuating portion 42 for pivotally moving the pivoting member, urging portions 44 causing the contacts 14, 16 to be elastically deformed, and anchoring holes 46 independent from one another each into which part of the contact 14, 16 can be inserted, and said pivoting member 18 is arranged correspondingly to arrangement of the contacts 14, 16 so that the contact portions 28 of the contacts 14, 16 are brought into contact with the connecting object by pivotally moving said pivoting member 18 on the same side as or opposite side from the connector mounted side of a substrate. Therefore, the connector according to the invention can accommodate the mounting space on the substrate imposed by a customer's requirement and minimize the occupied area of the substrate (particularly, less than 3 mm in a depth direction) and is simple to operate.

(4) According to the invention, two of the pivoting members 18 are arranged so as to face to each other in the width direction, and by pivotally moving the actuating portions 42 of the pivoting member 18 on the opposite side from the connector mounted side of the substrate, the contact portions 28 of the contacts 14, 16 are brought into contact with the connecting object. Therefore, the connector according to the invention can accommodate the mounting space on the substrate imposed by a customer's requirement and minimize the occupied area of the substrate (particularly, less than 3 mm in a depth direction) and is able to realize a high density in conductors and simple to operate.

(5) According to the invention, when the connector is mounted on a side surface of the substrate 80, the substrate 80 is provided with a notch 82 so that the connector 10 is fitted in the notch 82 of the substrate. Therefore, the members or pivoting members are simple to operate, and the connector achieves a reduced overall height of the order of 0.9 mm and can minimize the occupied area of the substrate (particularly, in a depth direction).

(6) According to the invention, the contacts 14, 16 are substantially H-shaped, and the substrate 80 is provided with the notch 82 having a depth of 3 mm or less, into which the connector 10 is fitted. In this way, the occupied area of the substrate (particularly, in a depth direction) can be minimized.

(7) According to the invention, the contacts 14, 16 each comprise a first piece 24 having a contact portion 28 adapted to contact the connecting object at one end and a pressure receiving portion 30 adapted to be urged by the pivoting member 18 at the other end, a second piece 26 having a further contact portion 28 adapted to contact the connecting object at one end and a connection portion 32 adapted to be connected to the substrate 80 at the other end, and a jointing portion 34 for connecting the first and second pieces 24 and 26, and holding means permitting the urging portion 44 of the pivoting member 18 to pivotally move between the pressure receiving portion 30 and the second piece 26 facing thereto, wherein the pivoting member 18 comprises an actuating portion 42 for pivotally moving the pivoting member, urging portions 44 arranged continuously in a longitudinal direction and causing said contacts 14, 16 to be elastically deformed, and anchoring holes 46 independent from one another each into which part of the pressure receiving portion 30 can be inserted, and the pivoting member 18 is mounted on the housing 12 so that the urging portions 44 are pivotally moved between the pressure receiving portions 30 and the second pieces 26 facing thereto of said contacts 14, 16, and wherein when the urging portions 44 are pivotally moved, a rotational axis of the urging portions is moved with their pivotal movement to perform a compact rotation, and when the actuating portion 42 is pivotally moved in a direction at right angles to the direction of the fitting opening 20 of the housing 12 and away from the connection portions 32 of said contacts 14, 16 so that the contact portions 28 of said contacts 14, 16 are brought into contact with the connecting object. Consequently, according to the invention, the pivoting members 18 are simple to operate, and the connector achieves a reduced overall height of the order of 0.9 mm and can minimize the occupied area of the substrate (particularly, in a depth direction).

(8) According to the invention, as the holding means, at least every other contact 14, 16 is provided on the second piece 26 with a raised portion 40 extending toward the pressure receiving portion 30, while the pressure receiving portion 30 of the first piece 24 is provided with a protruded portion 38 extending toward the raised portion 40 so that the protruded portions 38 and the raised portions 40 are staggered relative to each other, thereby holding the urging portions 44 of the pivoting members 18 to permit their pivotal movement. Therefore, stable rotation of the pivoting member 18 can be accomplished, and the occupied area of the substrate can be minimized (3.0 mm in a depth direction) because the pivoting members are caused to rotate toward the fitting side.

(9) According to the invention, as the holding means, at least every other contact 14, 16 is provided with a protrusion 41 extending toward the pressure receiving portion 30 between the raised portion 40 of the second piece 26 and the jointing portion 34. Consequently, stable rotation of the pivoting members 18 can be accomplished, and the occupied area of the substrate can be minimized (3.0 mm in a depth direction) because the pivoting members are caused to rotate toward the fitting side.

(10) According to the invention, the contacts 14, 16 provided with protruded portion 38 and the raised portion 40 and the contacts 14, 16 provided with the protrusion 41 are staggered relative to each other. In this way, narrower pitches can be realized and stable rotation of the pivoting members 18 can be accomplished, and the occupied area of the substrate can be minimized (3.0 mm in a depth direction) because the pivoting members are caused to rotate toward the fitting side.

(11) According to the invention, the contacts 14, 16 are each provided with a projection at the tip of the pressure receiving portion 30 of the first piece 24. Therefore, it is possible to prevent the center portion of the housing 12 from being deformed toward the fitting opening 20 due to reaction force against the pivotal movement of the pivoting member 18.

(12) According to the invention, the protruded portion 38, the raised portion 40 and the protrusion 41 are arranged substantially at apexes of a triangle. In this manner, the urging portions 44 of the pivoting members 18 can be held to permit their pivotal movements.

(13) According to the invention, when the connecting object is connected to the connector 10, the urging portions 44 of the pivoting member 18 are positioned such that before connecting the connecting object to the connector 10, the lower ends 68 of the urging portions 44 of the pivoting member 18 are in a state contacting the protrusions 41, that second at pivotally moving the actuating portion 42, lower ends 68 of the urging portions 44 in contact with the protrusions 41 are pivotally moved about a center of rounded shape of said lower ends 68 as a rotational axis 64 so that said urging portions 44 comes into a slightly inclined state, that third on further pivotally moving the actuating portion 42 the lower ends 68 are somewhat moved from the second state toward the connection portions 32 and pivotally moved about the center of the urging portions 44 as a rotational axis 64 so that the urging portions 44 come into a substantially vertical state, that fourth on further pivotally moving the actuating portion 42, the lower ends 68 are further moved from the third state toward the connection portions 32 and upper ends 66 of the urging portions 44 move toward the protruded portions 38 so that the urging portions 44 come into a vertical state, that fifth on further pivotally moving the actuating portion 42, the lower ends 68 are further moved from the fourth state toward the connection portions 32 and the upper ends 66 of the urging portions 44 come into a state contacting with the protruded portions 38, and that finally on further pivotally moving the actuating portion 42 from the fifth state, the urging portions 44 are pivotally moved about a center of rounded shape of the upper ends 66 as a rotational axis 64 so that said contact portions 28 of said contacts 14, 16 are brought into contact with the connecting object by pivotally moving the pivoting member 18 toward the direction of the fitting opening 20 of the housing 12, and clearances are provided between axles of the pivoting member 18 and bearing portions of the housing 12, thereby enabling a compact rotation of the urging portions of the pivoting member. With such a construction according to the invention, the urging portions 44 of the pivoting members 18 are rotated with a variable rotational axis without rotating about a fixed axis so that the urging portions can achieve a compact rotation and serve to contribute to the reduced overall height of the connector.

(14) According to the invention, the connection portions 32 or the contact portions 28 of the contacts 14, 16 are staggered relative to each other. Therefore, narrower pitches can be realized.

DESCRIPTION OF THE PREFERRED EMBODIMENTS

In the embodiment, pivoting members are used as members for urging a connecting object against contact portions of contacts. The connector explained herein is a connector connected to an end face of a substrate, and the pivoting members are actuated on the side of the substrate opposite from its surface on which the connector is mounted.

Figure 1A:
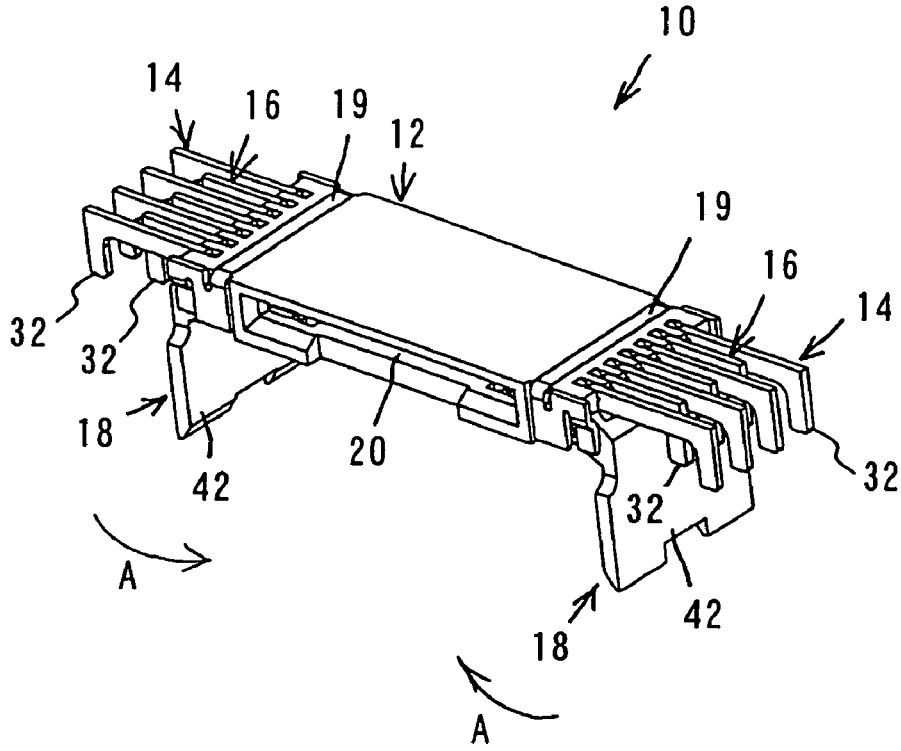
FIG. 1A is a perspective view of the connector according to the invention with the pivoting members opened, viewed from above on the fitting opening side.
Figure 1B:
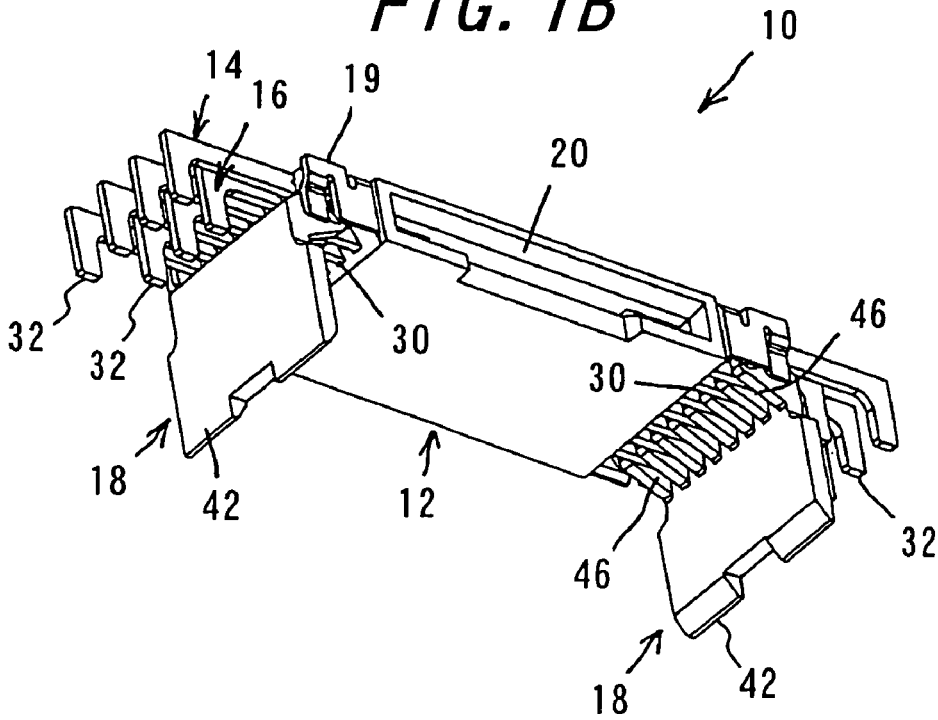
FIG. 1B is a perspective view of the connector according to the invention with the pivoting members opened, viewed from below on the fitting opening side.
Figure 2A:
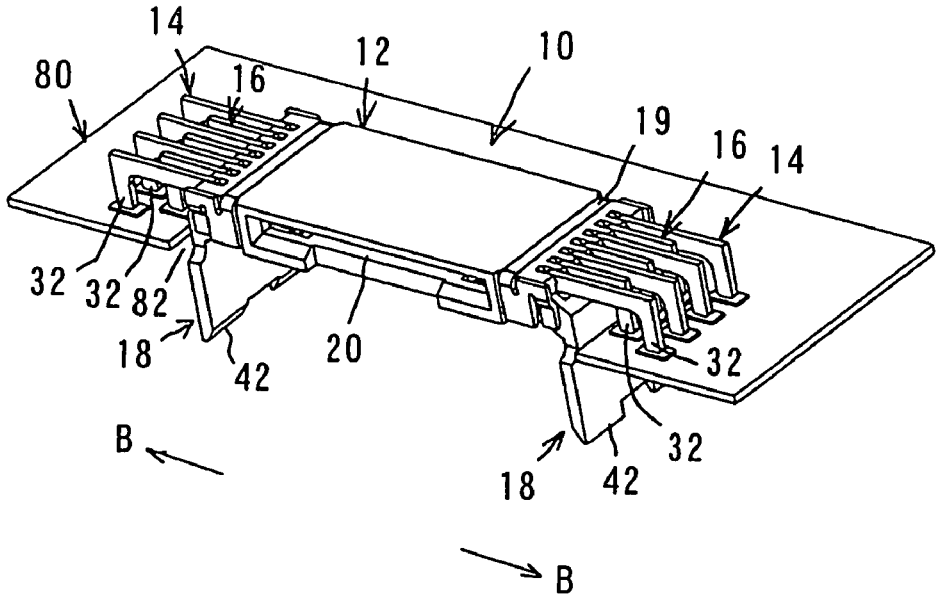
FIG. 2A is a perspective view of the connector according to the invention mounted on a substrate with the pivoting members opened, viewed from above on the fitting opening side.
Figure 2B:
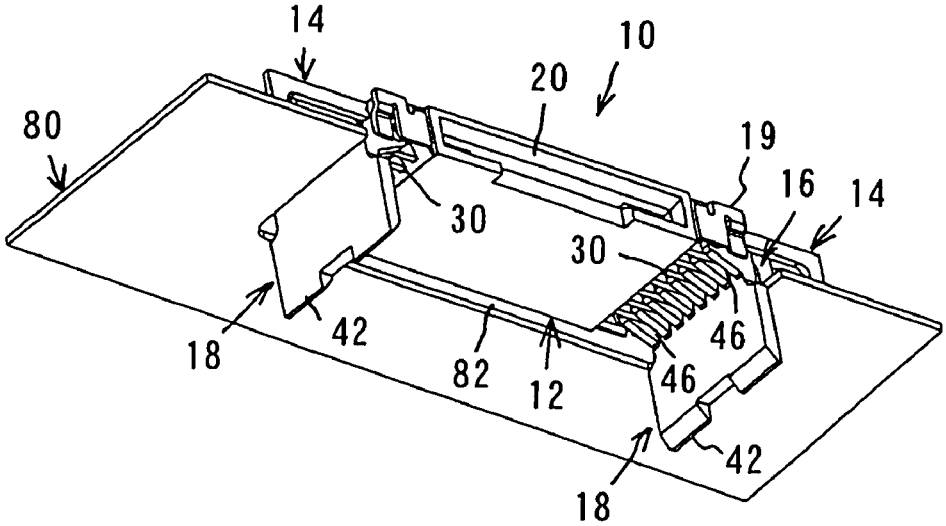
FIG. 2B is a perspective view of the connector according to the invention mounted on a substrate with the pivoting members opened, viewed from below on the fitting opening side.
Figure 3A:
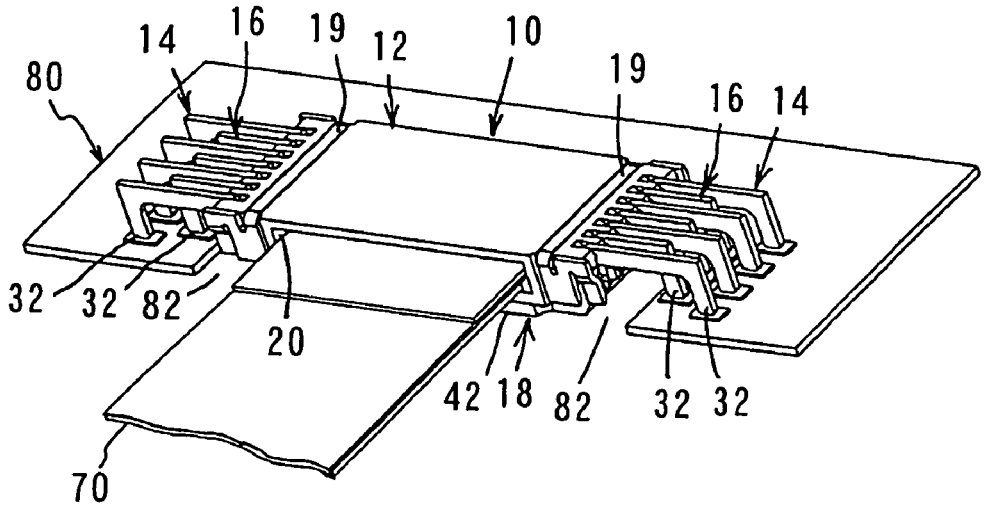
FIG. 3A is a perspective view of the connector according to the invention mounted on the substrate with a flexible printed circuit board inserted, viewed from above on the fitting opening side.
Figure 3B:
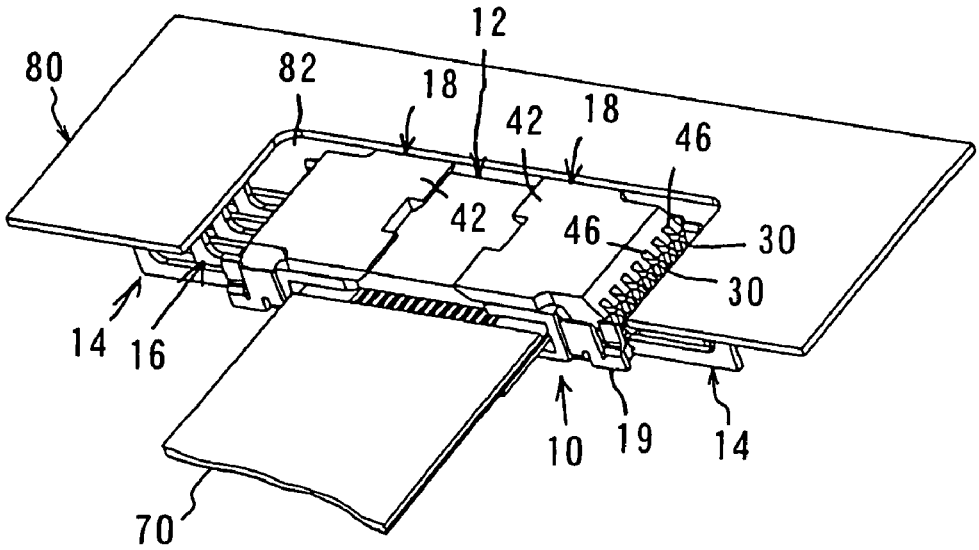
FIG. 3B is a perspective view of the connector according to the invention mounted on the substrate with a flexible printed circuit board inserted, viewed from below on the fitting opening side.
Figure 4A:
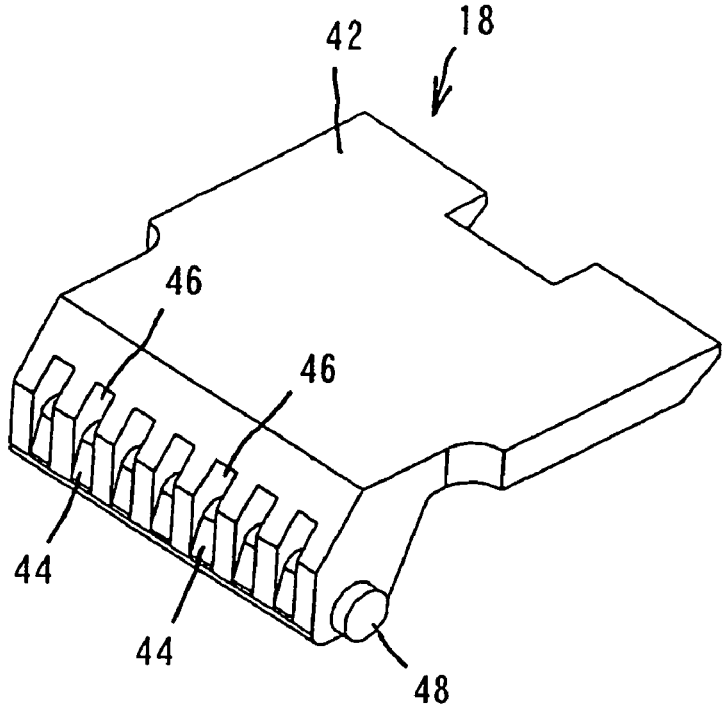
FIG. 4A is a perspective view of the pivoting member viewed from above.
Figure 4B:
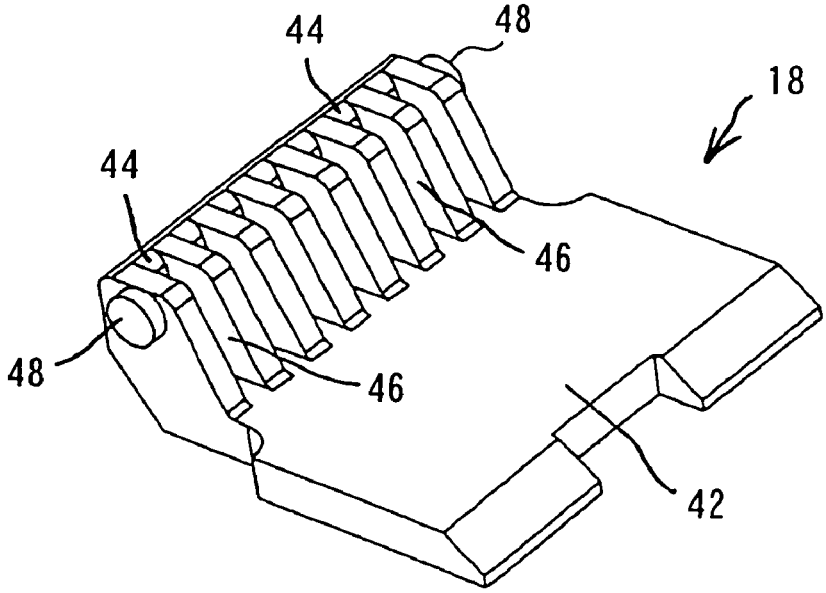
FIG. 4B is a perspective view of the pivoting member viewed from below.
Figure 5A:
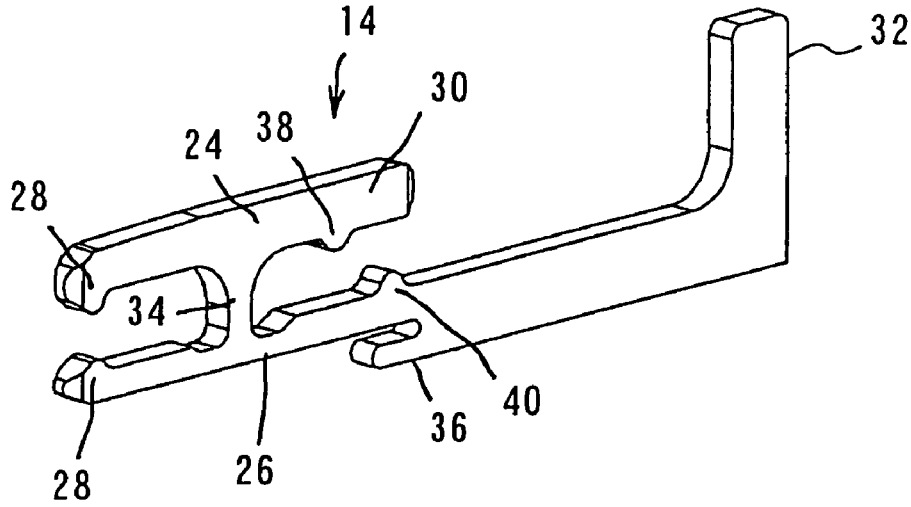
FIG. 5A is a perspective view of a contact of one kind.
Figure 5B:
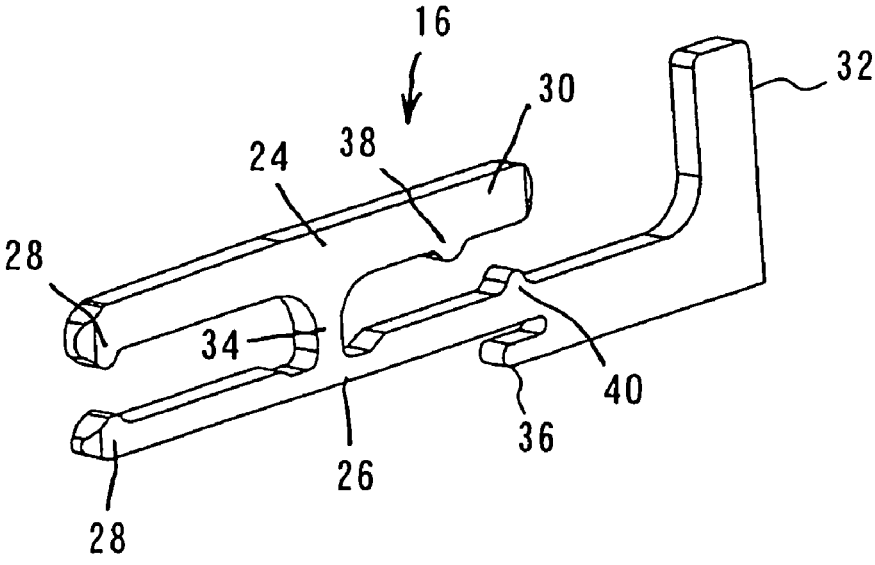
FIG. 5B is a perspective view of a contact of the other kind.
Figure 6A:
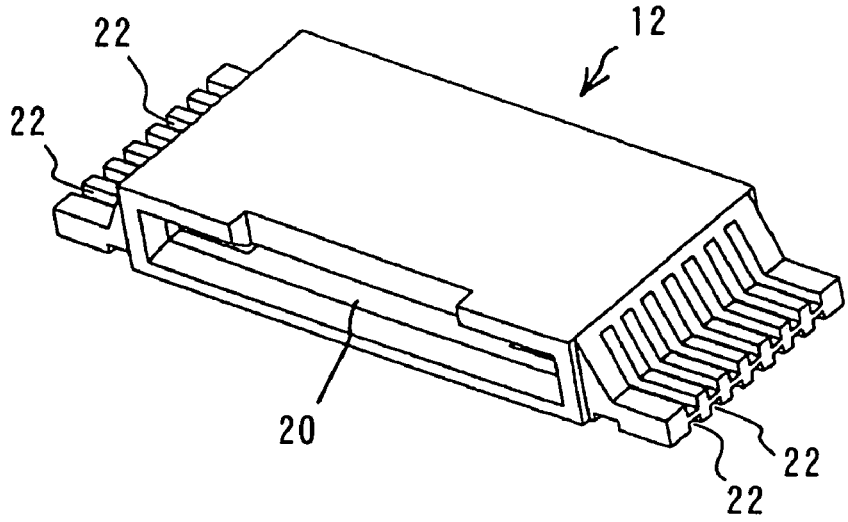
FIG. 6A is a perspective view of the housing viewed from above on the fitting opening side.
Figure 6B:
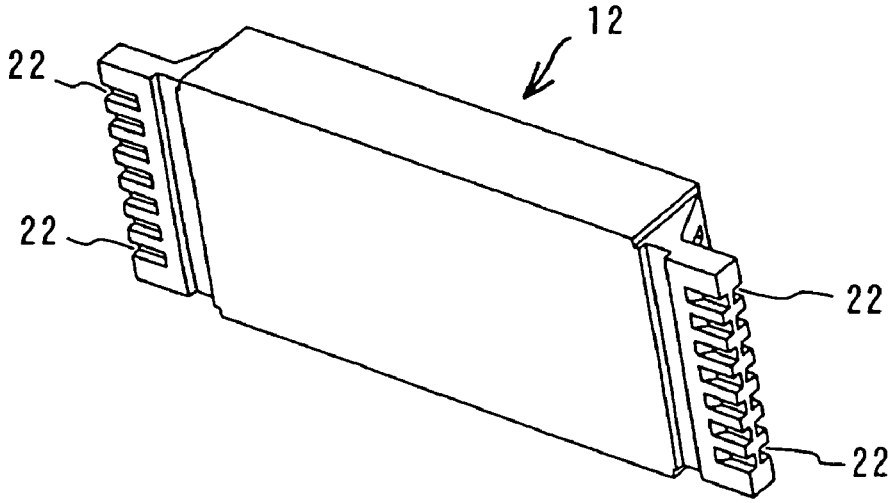
FIG. 6B is a perspective view of the housing viewed from below on the fitting opening side.
Figure 7A:
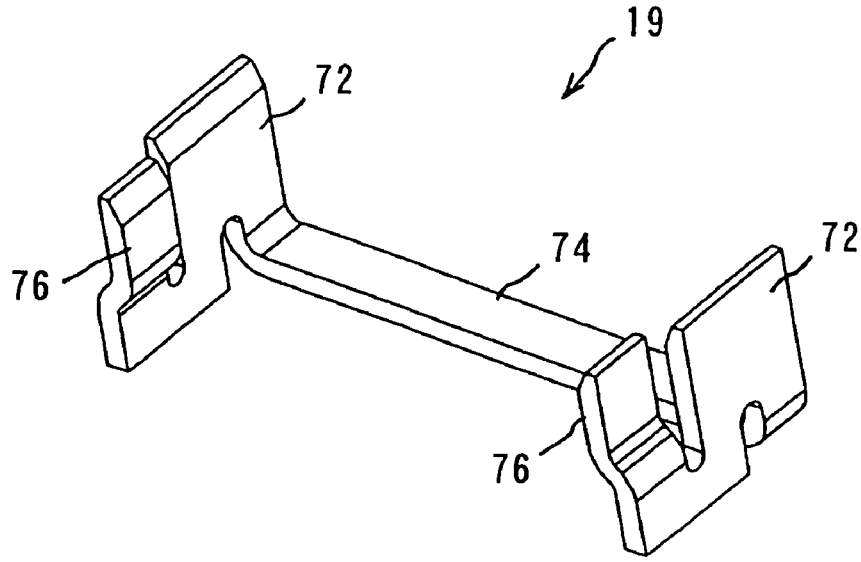
FIG. 7A is a perspective view of the fixing member for fixing the pivoting member to the housing viewed from the engaging side with the housing.
Figure 7B:
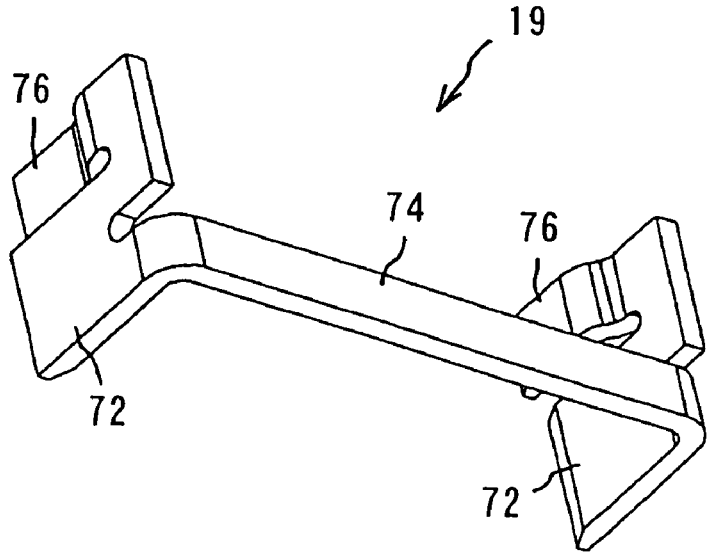
FIG. 7B is a perspective view of the fixing member for fixing the pivoting member to the housing viewed from the opposite side from the engaging side with the housing.
Figure 8A:
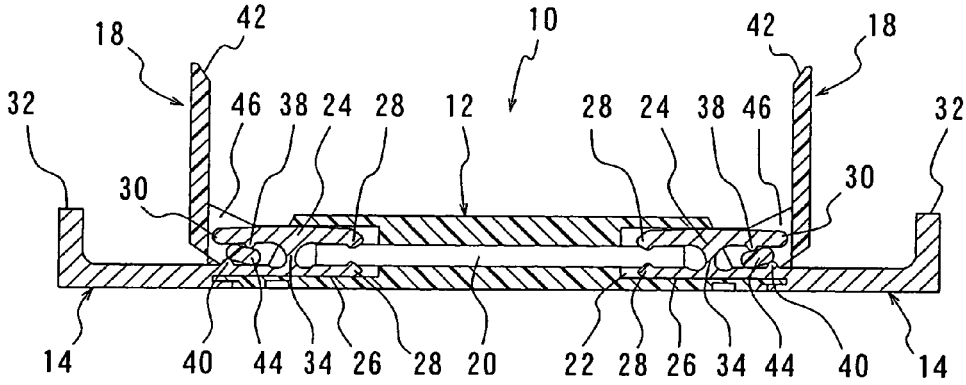
FIG. 8A is a sectional view of the connector according to the invention taken along the contact of the one kind without the flexible printed circuit board inserted.
Figure 8B:
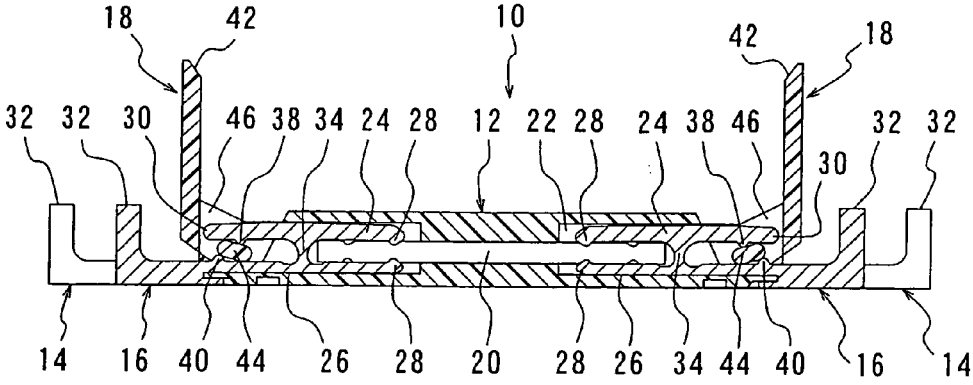
FIG. 8B is a sectional view of the connector according to the invention taken along the contact of the other kind without the flexible printed circuit board inserted.

One embodiment of the connector according to the invention will be explained with reference to FIGS. 1A to 8B. FIG. 1A is a perspective view of the connector according to the invention with pivoting members opened, viewed from the above on its fitting opening side. FIG. 1B is the connector of FIG. 1A viewed from the below on the fitting opening side. FIG. 2A is a perspective view of the connector according to the invention mounted on a substrate with the pivoting members opened, viewed from the above on the fitting opening side. FIG. 2B is a perspective view of the connector of FIG. 2A viewed from the below on the fitting opening side. FIG. 3A is a perspective view of the connector according to the invention mounted on the substrate with a flexible printed circuit board inserted, viewed from the above on the fitting opening side. FIG. 3B is a perspective view of the connector of FIG. 3A viewed from the below on the fitting opening side. FIG. 4A is a perspective view of the pivoting member viewed from the above. FIG. 4B is a perspective view of the pivoting member of FIG. 4*a* viewed from the below. FIG. 5A is a perspective view of one kind of contact and FIG. 5B is a perspective view of the other kind of contact. FIG. 6A is a perspective view of a housing of the connector according to the invention viewed from the above on the fitting opening side. FIG. 6B is a perspective view of the housing of FIG. 6A viewed from the below on the fitting opening side. FIG. 7A is a perspective view of a fixing member for pivotally mounting the pivoting member on the housing viewed from the engaging direction with the housing. FIG. 7B is a perspective view of the fixing member of FIG. 7A viewed from the opposite side from the engaging direction. FIG. 8A is a sectional view of the connector according to the invention taken along the one kind of contact with the flexible printed circuit board not inserted. FIG. 8B is a sectional view of the connector of FIG. 8A taken along the other kind of contact. FIG. 9A to 9F are explanatory views for explaining movements of urging portions and their axis of rotation when the pivoting member is being pivoted.

A substrate will be explained before explaining components of the connector according to the invention. Plural kinds of other parts are mounted on the mounting surface of the substrate on which the connector is mounted. The mounting surface of the substrate is further provided with lands for soldering the connector 10 thereto, and the lands are connected to the other parts by patterns. The substrate is formed with a notch so that the connector is connected to the substrate in a manner that the connector is fitted in the notch of the substrate. The size of the notch of the substrate depends on specifications (pitches and the number of conductors) of the connector, and the depth of the notch may be 3 mm or less and the width is 8.4 mm in consideration of operationality, size and other specifications of the pivoting members.

The components of the connector according to the invention will be explained with reference to the drawings. First, the two kinds of contacts 14 and 16 will be explained. The contacts 14, 16 are made of a metal and formed by means of the press-working of the known technique. Preferred metals from which to form the contacts include brass, beryllium copper, phosphor bronze and the like which comply with the requirements such as springiness, electric conductivity and the like.

First, the one kind of contacts 14 will be explained. As shown in FIG. 5A, the contact 14 is substantially H-shaped (except for its connection portion) and comprises a first pieced 24 having a contact portion 28 adapted to contact a connecting object at one end and a pressure receiving portion 30 adapted to be urged by a pivoting member 18 at the other end, a second piece 26 having a further contact portion 28 at one end and a connection portion 32 adapted to be connected to the substrate 80 at the other end, a jointing portion 34 for connecting the first and second pieces 24 and 26, a fixed portion 36 for holding the contact 14 on a housing 12, and holding means permitting an urging portion 44 of the pivoting member 18 to be pivotally moved between the pressure receiving portion 30 and the second piece 26 facing thereto.

The contact portions 28 are in the form of a protrusion for enabling the contact portions to be easily into contact with the connecting object such as a flexible printed circuit board or flexible flat cable. The connection portion 32 in the illustrated embodiment is of a surface mounting type (SMT) as shown in FIG. 5A, but it may be of a dip type. The connection portion 32 is substantially L-shaped and is fixed such that its upstanding portion is substantially perpendicular to the lands of the substrate 80.

The jointing portion 34 and the pressure receiving portion 30 serve to perform the following function when the connecting object such as the flexible printed circuit board 70 or a flexible flat cable is inserted into the connector. After the connecting object such as the flexible printed circuit board 70 or the flexible flat cable has been inserted into the fitting opening 20 of the housing 12, the urging portions 44 of the pivoting member 18 are pivotally moved between the pressure receiving portions 30 and the second pieces 26 of the contacts facing thereto to raise the pressure receiving portions 30 by the urging portions 44 so that the upper ends of the jointing portions 34 are tilted toward the contact portions 28 of the first pieces 24 about the lower ends of the jointing portions 34 of the contacts 14 as fulcrums. As a result, the contact portions 28 are urged against the connecting object such as the flexible board or flexible flat cable. The sizes and shapes of the jointing portion 34 and the pressure receiving portion 30 may be suitably designed in order to achieve such functions.

As the holding means, at least every other second piece 24 of the contacts 14 and 16 is provided with a raised portion 40 extending toward the pressure receiving portion 30, while the pressure receiving portion 30 of the first piece 24 is also provided with a protruded portion 38 extending toward the raised portion 40 in a manner that the protruded portions 38 and the raised portions 40 are staggered relative to each other, thereby holding the urging portions 44 of the pivoting member 18 in a manner permitting their pivotal movement. The sizes and shapes of the protruded portions 38 and the raised portions 40 may be of any ones insofar as they can hold the urging portions 44 of the pivoting member 18 to permit their pivotal movement and may be suitably designed to hold the urging portions by the protrusions 40 and projections 38 in a manner permitting pivotal movement of the urging portions. In the illustrated embodiment, the protruded portions 38 and the raised portions 40 are shaped to have substantially triangular cross-sections and their sizes are of the order of 0.08 mm.

As the holding means, at least every other second piece of the contacts 14 and 16 may be provided with a protrusion 41 (refer to FIG. 9A) extending toward the pressure receiving portion 30 between the raised portion 40 of the second piece 26 and the jointing portion 34. The size and shape of the protrusions 41 may be of any ones so long as they can hold the urging portions 44 of the pivoting member 18 to permit their pivotal movement and may be suitably designed to enable the urging portions to be held by them permitting their pivotal movement. In the event that the protrusions 41 are provided, it is desirable to arrange the protruded portion 38, the raised portion 40 and the protrusion 41 at apexes of a triangle, thereby enabling the urging portions 44 of the pivoting member 18 to be stably held in the manner permitting their pivotal movement.

Moreover, the contacts 14 provided with the protruded portion 38 and raised portion 40 and the contacts 16 provided with the protrusions 41 may be arranged to be staggered relative to each other.

It is preferable to provide a projection (not shown) extending inwardly on the tip of the pressure receiving portion 30 of either or both of the contacts 14 and 16. Such projections serve to prevent the pivoting member 18 from being deformed at its center in the directions shown by arrows B in FIG. 2A due to strong reaction against the pivotal movement of the pivoting member 18 when causing its urging portions 44 to pivotally move between the pressure receiving portions 30 and the second pieces 26 facing thereto of the contacts 14 and 16. The projections may be of any size insofar as they can achieve their function and may be suitably designed to an extent such that the urging portions 44 of the pivoting member 18 catch on the projections.

In addition, the projections further serve to hold the urging portions 44 of the pivoting member 18 to prevent them from falling down when the contacts 14 and 16 contact the connecting object after the pivoting member 18 has been pivoted.

The other kind of contact 16 will be explained. Differences of the contact 16 from the contact 14 only will be explained. The contact 16 is similar to the contact 14 in shape except for the distances from the jointing portion 34 to the contact portion 28 and from the jointing portion 34 to the connection portions 32. In other words, the distance between the jointing portion 34 and the contact portion 28 of the other kind of contact 16 is approximately 0.6 mm longer than that of the contact 14, while the distance between the joining portion 34 and the connection portion 32 of the other kind of contact 16 is approximately 0.8 mm shorter than that of the contacts 14.

The pivoting members 18 will then be explained with reference to FIGS. 4A and 4B. The pivoting members 18 are formed from an electrically insulating plastic material by means of the injection molding of the known technique. The materials suitable for the pivoting members 18 generally include polybutylene terephthalate (PBT), polyamide (66PA or 46PA), liquid crystal polymer (LCP), polycarbonate (PC) and the like and combination thereof and may be suitably selected in consideration of dimensional stability, workability, manufacturing cost and the like. The pivoting member 18 mainly comprises an actuating portion 42, axles 48 for pivotally mounting the pivoting member 18 on the housing 12, urging portions 44 adapted to urge the pressure receiving portions 30 of the contacts 14 and 16, and anchoring holes 46 into which tips of the pressure receiving portions 30 of the contacts 14 and 16 engage. The axles 48 are fulcrums for the pivotal movement of the pivoting member 18 and suitably fitted in bearing holes formed in longitudinal ends of the housing 12 to enable the pivoting member 18 to be pivotally moved.

The urging portions 44 serve to urge the pressure receiving portions 30 of the contacts 14 and 16. It is desirable to form the urging portions 44 into an elongated shape, and they are formed to have an elliptical cross-section in the illustrated embodiment. With such urging portions having the elliptical cross-section, when the pivoting member 18 is pivotally moved in the direction shown by arrows A in FIG. 1A so as to rotate the urging portions 44 in the space between the pressure receiving portions 30 and the second pieces 26 facing thereto of the contacts 14 and 16, the pressure receiving portions 30 of the contacts 14 and 16 are moved upwardly with variation in contact height owing to the elliptical shape of the urging portions 44, thereby causing the contact portions 28 of the contacts 14 and 16 to be pressed against the connecting object. The urging portions 44 can be formed in any shape insofar as they can rotate between the pressure receiving portions 30 and the second pieces 26 facing thereto of the contacts 14 and 16, and the pressure receiving portions 30 of the contacts 14 and 16 can be raised with the aid of the variation in contact height owing to, for example, difference in major and minor axes of an ellipse.

The pivoting member 16 is provided with the anchoring holes 46 independently from one another, which are adapted to engage projections (not shown) of the contacts 14 and 16 for the purpose of preventing the pivoting member 18 from being deformed at the middle in the directions shown by arrows B in FIG. 2A due to strong reaction against the pivotal movement of the pivoting member 18. The independently provided anchoring holes 46 serve to increase the strength of the pivoting member 18 and to prevent its deformation when being pivotally moved.

In the present embodiment, the pivoting member 18 has a substantially L-shaped cross-section. The two pivoting members 18 are arranged at opposite ends in the width direction of the housing in a manner such that their actuating portions 42 can be pivotally operated on the side of the substrate opposite from its connector mounting side.

The housing 12 will then be explained. The housing 12 is formed from an electrically insulating plastic material by means of the injection molding of the known technique. The materials suitable for the housing 12 generally include polybutylene terephthalate (PBT), polyamide (66PA or 46PA), liquid crystal polymer (LCP), polycarbonate (PC) and the like and combination thereof and may be suitably selected in consideration of dimensional stability, workability, manufacturing cost and the like.

The housing 12 is formed with inserting holes 22 on both sides in the width direction of the housing, in which a required number of contacts 14 and 16 are inserted and fixed thereat by press-fitting, hooking (lancing), welding or the like.

The housing 12 is further formed with mounting portions at predetermined positions on both side in the width direction for mounting the fixing members 19 which serve to pivotally mount the pivoting members 18, respectively. Sizes and shapes of the mounting portions may be suitably designed in consideration of the possibility of pivotal movement of the pivoting members and miniaturization of the connector 10. In the present embodiment, while the pivoting members 18 are pivotally mounted on the housing 12 by the use of the fixing members 19 as separate parts, the pivoting members 18 may be directly mounted on the housing 12 by providing on the housing with bearing portions for axles 48 of the pivoting member 18 without using the fixing members, insofar as the pivoting members 18 are pivotally movable.

The housing 12 is formed with a fitting opening 20 for inserting the flexible printed circuit board 70. The fitting opening 20 is formed by four walls surrounding all the four sides of the fitting opening, and when the contacts 14 and 16 are installed in the inserting holes 22, the tips of contact portions 28 of the contacts 14 and 16 extend into the fitting opening 20.

The fixing members 19 will then be explained with reference to FIGS. 7A and 7B. The fixing members 19 serve to pivotally mount the pivoting members 18 on the housing and may be made of a metal or an electrically insulating plastic material so long as it can fulfill such a function. If the fixing members are made of a metal, it may be formed by means of the press-working of the known technique, and preferred metals from which to form the fixing members include brass, beryllium copper, phosphor bronze and the like which comply with the requirements such as dimensional stability, springiness and the like. If the fixing members are made of an electrically insulating plastic material, it may be formed by means of the injection molding of the known technique. The materials suitable for the fixing members 19 generally include polybutylene terephthalate (PBT), polyamide (66PA or 46PA), liquid crystal polymer (LCP), polycarbonate (PC) and the like and combination thereof, which may be suitably selected in consideration of dimensional stability, workability, manufacturing cost and the like. In the present embodiment, the fixing members 19 are made of a stainless steel (SUS) in consideration of its strength and ease in assembling. The fixing member 19 mainly comprises plate-shaped pieces 72, a connecting piece 74 and elastic pieces 76. The fixing member 19 is substantially U-shaped, and the two plate-shaped pieces 72 are connected by the connecting piece 74. The plate-shaped pieces 72 are each provided near the piece 72 with the elastic piece 76 having an elasticity separated from the plate-shaped piece 72 by a slit. A distance between the two elastic pieces 76 is approximately 0.2 mm smaller than that between the two plate-shaped pieces 72 so that the pivoting member 18 is embraced and held between the elastic pieces 76. When the pivoting member 18 is in its opened position, the axles 48 of the pivoting member 18 engage the elastic pieces 76 so that the pivoting member 18 is prevented from further moving onto the side onto which the connection portions 32 of the contacts 14 and 16 extend. The axles 48 of the pivoting member are in contact with the plate-shaped pieces 72, and under such a state, the axles 48 are rotatable for pivotal movement of the pivoting member 18. The fixing members 19 are fixed to the housing 12 by means of press-fitting, welding, hooking with elasticity, or the like.

The movement and pivotal movement of the urging portions 44 of the pivoting member 18 will be explained herein with reference to FIGS. 9A to 9F.

Figure 9A:
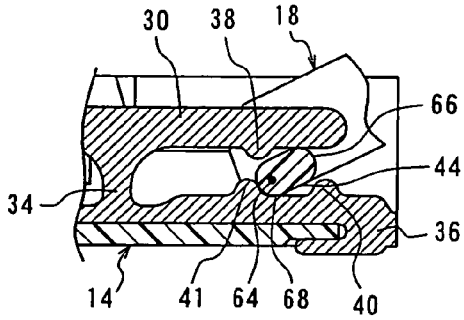
FIGS. 9A to 9F are explanatory views for explaining the movements of the urging portions and rotational axis when the pivoting member is pivotally moved.

FIG. 9A illustrates the state that the connecting object is not inserted into the connector 10. The lower end 68 of the urging portion 44 of the pivoting member 18 contacts the protrusion 41 of the contact.

Figure 9B:
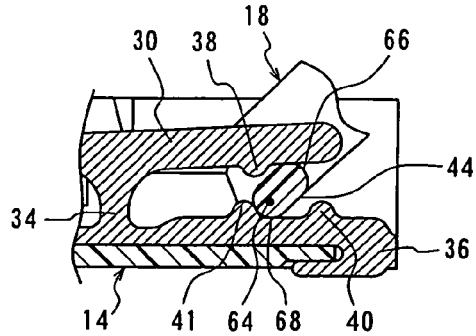

As shown in FIG. 9B, when the actuating portion 42 of the pivoting member is pivotally moved (in the clockwise direction as viewed in the drawing), the lower end 68 of the urging portion 44 is in contact with the protrusion 41 and pivotally moved about a center of the rounded shape of the lower end 68 as a rotational axis 64 so that the urging portion 44 comes into a slightly inclined position.

Figure 9C:
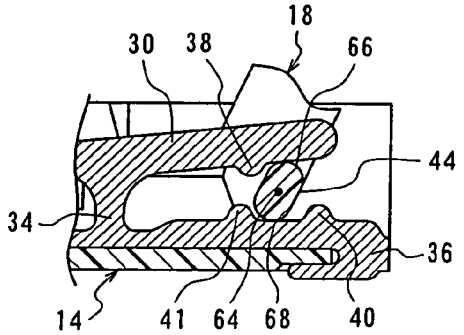

As shown in FIG. 9C, when the actuating portion 42 is further pivotally moved, the lower end 68 of the urging portion 44 is somewhat moved from its position shown in FIG. 9B toward the connection portion 32 and pivotally moved about the center of the urging portion 44 as the rotational axis 64 so that the urging portion 44 comes into a substantially vertical position.

Figure 9D:
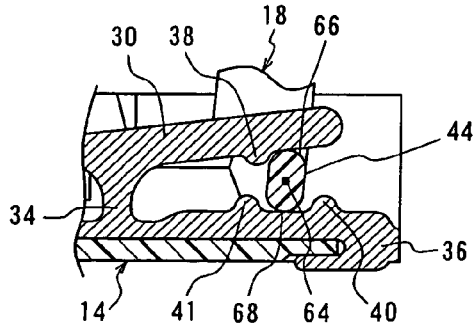

As shown in FIG. 9D, when the actuating portion 42 is further pivotally moved, the lower end 68 is further moved from the condition shown in FIG. 9C toward the connection portion 32 and the upper end 66 of the urging portion 44 moves toward the protruded portion 38 so that the urging portion 44 comes into a vertical position.

Figure 9E:
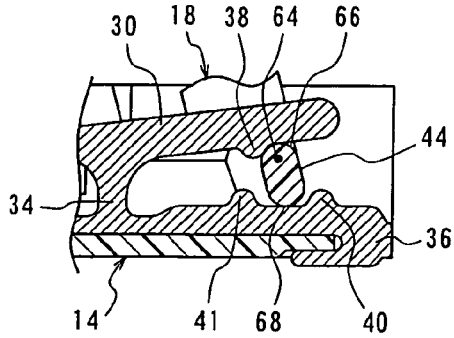

As shown in FIG. 9E, when the actuating portion 42 is further pivotally moved, the lower end 68 is further moved from the condition shown in FIG. 9D toward the connection portion 32 and the upper end 66 of the urging portion 44 comes into contact with the protruded portion 38.

Figure 9F:
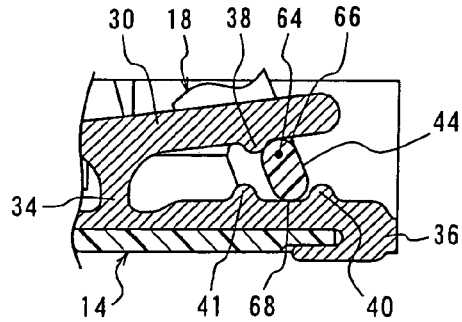

As shown in FIG. 9F, when the actuating portion 42 is further pivotally moved, the urging portion 44 is pivotally moved about a center of the rounded shape of the upper end 66 as a rotational center 64 so that the urging portion 44 is pivotally moved in the direction toward the fitting opening 20 of the housing 12, thereby bringing the contact portions 32 of the contacts 14 into contact with the connecting object.

In other words, the urging portion 44 of the pivoting member is initially moved and then pivotally moved, and when the urging portion 44 continues to pivotally move, the rotational axis 64 progressively changes in position so that the urging portion 44 performs the compact and space saving pivotal movement (rotation).

In the connector 10 according to the invention, namely, when a connecting object such as a flexible printed circuit board 70 or the like is inserted into the fitting opening 20 of the connector, a large force is not required (because of the so-called "zero-insertion" type connector). Then, the urging portions 44 of the pivoting member 18 are pivotally moved at a location on the side of the projections (not shown) of the contacts 14 or 16 to urge the pressure receiving portions 30 of the contacts 14, 16 upwardly at a location closer to the projections (not shown) so that the pivoting member 18 can be locked with a little force. Moreover, the pressure receiving portions 30 of the contacts 14, 16 are urged upwardly on the side of the projections (not shown) by the urging portions 44 of the pivoting member 18 so that higher contact force can be obtained between the contacts and the connecting object.

Finally, mounting the connector 10 onto the substrate 80 will be explained. In reply to the need for reduced overall height of connectors in recent years, the substrate 80 is formed with a notch 82 and the connector 10 is fitted in the notch 82 of the substrate. In this way, the reduced overall height including the substrate 80 and the connector can be achieved. In other words, it becomes possible to reduce the overall height of the connector by a height equivalent to the thickness of a substrate 80. Even if the height of the connector including a substrate of 0.4 mm in thickness is 1.0 mm, the overall height of the connector including the substrate 80 can be of the order of 0.6 mm. The size of the notch 82 of the substrate 80 may be suitably designed in consideration of the size of the connector 10, the strength of the substrate 80 and fitting position of the connector to the substrate.

The invention is applicable to connectors for use in electric and electronic appliances such as mobile devices, and more particularly to connectors superior in stable electrical connection with a connecting object such as a flexible printed circuit board or flexible flat cable and capable of realizing simplification of mounting in which the connector can be mounted on one surface of the substrate.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A connector including a plurality of contacts having at least one contact portion adapted to contact a connecting object, a housing arranging and holding said contacts and having a fitting opening into which said connecting object is inserted, and a member for bringing said connecting object into contact with the contact portions of said contacts, wherein said contacts are arranged orthogonally to the inserting direction of said fitting opening of the housing so that connection portions of said contacts extend onto either or both sides of said housing in its width direction, and after said connecting object has been inserted into said fitting opening, said member is inserted or pivotally moved to bring said connecting object into contact with the contact portions of said contacts, and wherein said pivoting member at least comprises an actuating portion for pivotally moving the pivoting member, urging portions causing said contacts to be elastically deformed, and anchoring holes independent from one another each into which part of said contact can be inserted, and said pivoting member is arranged correspondingly to arrangement of said contacts so that the contact portions of said contacts are brought into contact with said connecting object by pivotally moving said pivoting member on the same side as or opposite side from the connector mounted side of a substrate.

2. The connector as set forth in claim 1, wherein when the connector is mounted on a side surface of the substrate, the substrate is provided with a notch so that said connector is fitted in said notch of the substrate.

3. The connector as set forth in claim 1, wherein said contacts each comprise a first piece having a contact portion adapted to contact said connecting object at one end and a pressure receiving portion adapted to be urged by said pivoting member at the other end, a second piece having a further contact portion adapted to contact said connecting object at one end and a connection portion adapted to be connected to the substrate at the other end, and a jointing portion for connecting said first and second pieces, and holding means permitting said urging portion of said pivoting member to pivotally move between said pressure receiving portion and the second piece facing thereto, wherein said pivoting member comprises an actuating portion for pivotally moving said pivoting member, urging portions arranged continuously in a longitudinal direction and causing said contacts to be elastically deformed, and anchoring holes independent from one another each into which part of said pressure receiving portion can be inserted, and said pivoting member is mounted on the housing so that said urging portions are pivotally moved between said pressure receiving portions and the second pieces facing thereto of said contacts, and wherein when said urging portions are pivotally moved, a rotational axis of said urging portions is moved with their pivotal movement to perform a compact rotation, and when said actuating portion is pivotally moved in a direction at right angles to the direction of the fitting opening of said housing and away from the connection portions of said contacts so that the contact portions of said contacts are brought into contact with said connecting object.

4. The connector as set forth in claim 3, wherein as said holding means, at least every other contact is provided on said second piece with a raised portion extending toward said pressure receiving portion, while said pressure receiving portion of said first piece is provided with a protruded portion extending toward said raised portion so that said protruded portions and said raised portions are staggered relative to each other, thereby holding the urging portions of said pivoting member to permit their pivotal movement.

5. The connector as set forth in claim 3, wherein as said holding means, at least every other contact is provided on said second piece with a raised portion extending toward said pressure receiving portion, while said pressure receiving portion of said first piece is provided with a protruded portion extending toward said raised portion so that said protruded portions and said raised portions are staggered relative to each other, thereby holding the urging portions of said pivoting member to permit their pivotal movement.

6. The connector as set forth in claim 1, wherein the two pivoting members are arranged so as to face to each other in the width direction, and by pivotally moving said actuating portions of said pivoting members on the opposite side from the connector mounted side of the substrate, the contact portions of said contacts are brought into contact with said connecting object.

7. The connector as set forth in claim 6, wherein when the connector is mounted on a side surface of the substrate, the substrate is provided with a notch so that said connector is fitted in said notch of the substrate.

8. The connector as set forth in claim 6, wherein said contacts each comprise a first piece having a contact portion adapted to contact said connecting object at one end and a pressure receiving portion adapted to be urged by said pivoting member at the other end, a second piece having a further contact portion adapted to contact said connecting object at one end and a connection portion adapted to be connected to the substrate at the other end, and a jointing portion for connecting said first and second pieces, and holding means permitting said urging portion of said pivoting member to pivotally move between said pressure receiving portion and the second piece facing thereto, wherein said pivoting member comprises an actuating portion for pivotally moving said pivoting member, urging portions arranged continuously in a longitudinal direction and causing said contacts to be elastically deformed, and anchoring holes independent from one another each into which part of said pressure receiving portion can be inserted, and said pivoting member is mounted on the housing so that said urging portions are pivotally moved between said pressure receiving portions and the second pieces facing thereto of said contacts, and wherein when said urging portions are pivotally moved, a rotational axis of said urging portions is moved with their pivotal movement to perform a compact rotation, and when said actuating portion is pivotally moved in a direction at right angles to the direction of the fitting opening of said housing and away from the connection portions of said contacts so that the contact portions of said contacts are brought into contact with said connecting object.

9. The connector as set forth in claim 8, wherein as said holding means, at least every other contact is provided on said second piece with a raised portion extending toward said pressure receiving portion, while said pressure receiving portion of said first piece is provided with a protruded portion extending toward said raised portion so that said protruded portions and said raised portions are staggered relative to each other, thereby holding the urging portions of said pivoting member to permit their pivotal movement.

10. The connector as set forth in claim 8, wherein as said holding means, at least every other contact is provided on said second piece with a raised portion extending toward said pressure receiving portion, while said pressure receiving portion of said first piece is provided with a protruded portion extending toward said raised portion so that said protruded portions and said raised portions are staggered relative to each other, thereby holding the urging portions of said pivoting member to permit their pivotal movement.

11. A connector including a plurality of contacts having at least one contact portion adapted to contact a connecting object, a housing arranging and holding said contacts and having a fitting opening into which said connecting object is inserted, and a member for bringing said connecting object into contact with the contact portions of said contacts, wherein said contacts are arranged orthogonally to the inserting direction of said fitting opening of the housing so that connection portions of said contacts extend onto either or both sides of said housing in its width direction, and after said connecting object has been inserted into said fining opening, said member is inserted or pivotally moved to bring said connecting object into contact with the contact portions of said contacts, wherein said contacts each comprise a first piece having a contact portion adapted to contact said connecting object at one end and a pressure receiving portion adapted to be urged by said pivoting member at the other end, a second piece having a further contact portion adapted to contact said connecting object at one end and a connection portion adapted to be connected to the substrate at the other end, and a jointing portion for connecting said first and second pieces, and holding means permitting said urging portion of said pivoting member to pivotally move between said pressure receiving portion and the second piece facing thereto, wherein said pivoting member comprises an actuating portion for pivotally moving said pivoting member, urging portions arranged continuously in a longitudinal direction and causing said contacts to be elastically deformed, and anchoring holes independent from one another each into which part of said pressure receiving portion can be inserted, and said pivoting member is mounted on the housing so that said urging portions are pivotally moved between said pressure receiving portions and the second pieces facing thereto of said contacts, and wherein when said urging portions are pivotally moved, a rotational axis of said urging portions is moved with their pivotal movement to perform a compact rotation, and when said actuating portion is pivotally moved in a direction at right angles to the direction of the fitting opening of said housing and away from the connection portions of said contacts so that the contact portions of said contacts are brought into contact with said connecting object.

12. The connector as set forth in claim 11, wherein as said holding means, at least every other contact is provided on said second piece with a raised portion extending toward said pressure receiving portion, while said pressure receiving portion of said first piece is provided with a protruded portion extending toward said raised portion so that said protruded portions and said raised portions are staggered relative to each other, thereby holding the urging portions of said pivoting member to permit their pivotal movement.

13. The connector as set forth in claim 11, wherein as said holding means, at least every other contact is provided on said second piece with a raised portion extending toward said pressure receiving portion, while said pressure receiving portion of said first piece is provided with a protruded portion extending toward said raised portion so that said protruded portions and said raised portions are staggered relative to each other, thereby holding the urging portions of said pivoting member to permit their pivotal movement.

14. The connector as set forth in claim 13, wherein the contacts provided with protruded portion and said raised portion and the contacts provided with said protrusion are staggered relative to each other.

15. The connector as set forth in claim 14, wherein said protruded portion, said raised portion and said protrusion are arranged substantially at apexes of a triangle.

16. The connector as set forth in claim 11, wherein as said holding means, at least every other contact is provided with a protrusion extending toward said pressure receiving portion between the raised portion of said second piece and the jointing portion.

17. The connector as set forth in claim 16, wherein said contacts are each provided with a projection at the tip of the pressure receiving portion of said first piece.

18. The connector as set forth in claim 17, wherein when said connecting object is connected to said connector, the urging portions of the pivoting member are positioned such that before connecting said connecting object to said connector, the lower ends of the urging portions of said pivoting member are in a state contacting said protrusions, that second on pivotally moving said actuating portion, lower ends of said urging portions in contact with said protrusions are pivotally moved about a center of rounded shape of the lower ends as a rotational axis so that the urging portions comes into a slightly inclined state, that third on further pivotally moving said actuating portion said lower ends are somewhat moved from the second state toward said connection portions and pivotally moved about the center of said urging portions as a rotational axis so that said urging portions come into a substantially vertical state, that fourth on further pivotally moving said actuating portion, said lower ends are further moved from the third state toward said connection portions and upper ends of said urging portions move toward said protruded portions so that said urging portions come into a vertical state, that fifth on further pivotally moving said actuating portion, said lower ends are further moved from the fourth state toward said connection portions and the upper ends of said urging portions come into a state contacting with said protruded portions, and that finally on further pivotally moving said actuating portion from the fifth state, said urging portions are pivotally moved about a center of rounded shape of said upper ends as a rotational axis so that the contact portions of said contacts are brought into contact with said connecting object by pivotally moving said pivoting member toward the direction of the fitting opening of said housing, and clearances are provided between axles of said pivoting member and bearing portions of said housing, thereby enabling a compact rotation of said urging portions of said pivoting member.

19. A connector including a plurality of contacts having at least one contact portion adapted to contact a connecting object, a housing arranging and holding said contacts and having a fitting opening into which said connecting object is inserted, and a member for bringing said connecting object into contact with the contact portions of said contacts, wherein said contacts are arranged orthogonally to the inserting direction of said fitting opening of the housing so that connection portions of said contacts extend onto either or both sides of said housing in its width direction, and after said connecting object has been inserted into said fitting opening, said member is inserted or pivotally moved to bring said connecting object into contact with the contact portions of said contacts, and wherein said pivoting member at least comprises an actuating portion for pivotally moving the pivoting member, urging portions causing said contacts to be elastically deformed, and anchoring holes independent from one another each into which part of said contact can be inserted, and said pivoting member is arranged correspondingly to arrangement of said contacts so that the contact portions of said contacts are brought into contact with said connecting object by pivotally moving said pivoting member on the same side as or opposite side from the connector mounted side of a substrate.

20. The connector as set forth in claim 19, wherein when the connector is mounted on a side surface of the substrate, the substrate is provided with a notch so that said connector is fitted in said notch of the substrate.

21. A connector including a plurality of contacts having at least one contact portion adapted to contact a connecting object, a housing arranging and holding said contacts and having a fitting opening into which said connecting object is inserted, and a member for bringing said connecting object into contact with the contact portions of said contacts, wherein said contacts are arranged orthogonally to the inserting direction of said fitting opening of the housing so that connection portions of said contacts extend onto either or both sides of said housing in its width direction, and after said connecting object has been inserted into said fitting opening, said member is inserted or pivotally moved to bring said connecting object into contact with the contact portions of said contacts, wherein a pivoting member is used as said member, and after said connecting object has been inserted into said fitting opening, said pivoting member is pivotally moved to bring said connecting object into contact with the contact portions of said contacts, wherein said contacts each comprise a first piece having a contact portion adapted to contact said connecting object at one end and a pressure receiving portion adapted to be urged by said pivoting member at the other end, a second piece having a further contact portion adapted to contact said connecting object at one end and a connection portion adapted to be connected to the substrate at the other end, and a jointing portion for connecting said first and second pieces, and holding means permitting said urging portion of said pivoting member to pivotally move between said pressure receiving portion and the second piece facing thereto, wherein said pivoting member comprises an actuating portion for pivotally moving said pivoting member, urging portions arranged continuously in a longitudinal direction and causing said contacts to be elastically deformed, and anchoring holes independent from one another each into which part of said pressure receiving portion can be inserted, and said pivoting member is mounted on the housing so that said urging portions are pivotally moved between said pressure receiving portions and the second pieces facing thereto of said contacts, and wherein when said urging portions are pivotally moved, a rotational axis of said urging portions is moved with their pivotal movement to perform a compact rotation, and when said actuating portion is pivotally moved in a direction at right angles to the direction of the fitting opening of said housing and away from the connection portions of said contacts so that the contact portions of said contacts are brought into contact with said connecting object.

22. The connector as set forth in claim 21, wherein as said holding means, at least every other contact is provided on said second piece with a raised portion extending toward said pressure receiving portion, while said pressure receiving portion of said first piece is provided with a protruded portion extending toward said raised portion so that said protruded portions and said raised portions are staggered relative to each other, thereby holding the urging portions of said pivoting member to permit their pivotal movement.

23. The connector as set forth in claim 21, wherein as said holding means, at least every other contact is provided on said second piece with a raised portion extending toward said pressure receiving portion, while said pressure receiving portion of said first piece is provided with a protruded portion extending toward said raised portion so that said protruded portions and said raised portions are staggered relative to each other, thereby holding the urging portions of said pivoting member to permit their pivotal movement.

24. A connector including a plurality of contacts having at least one contact portion adapted to contact a connecting object, a housing arranging and holding said contacts and having a fitting opening into which said connecting object is inserted, and a member for bringing said connecting object into contact with the contact portions of said contacts, wherein said contacts are arranged orthogonally to the inserting direction of said fitting opening of the housing so that connection portions of said contacts extend onto either or both sides of said housing in its width direction, and after said connecting object has been inserted into said fitting opening, said member is inserted or pivotally moved to bring said connecting object into contact with the contact portions of said contacts, wherein a pivoting member is used as said member, and after said connecting object has been inserted into said fitting opening, said pivoting member is pivotally moved to bring said connecting object into contact with the contact portions of said contacts, wherein when the connector is mounted on a side surface of a substrate, the substrate is provided with a notch so that said connector is fitted in said notch of the substrate, wherein said contacts each comprise a first piece having a contact portion adapted to contact said connecting object at one end and a pressure receiving portion adapted to be urged by said pivoting member at the other end, a second piece having a further contact portion adapted to contact said connecting object at one end and a connection portion adapted to be connected to the substrate at the other end, and a jointing portion for connecting said first and second pieces, and holding means permitting said urging portion of said pivoting member to pivotally move between said pressure receiving portion and the second piece facing thereto, wherein said pivoting member comprises an actuating portion for pivotally moving said pivoting member, urging portions arranged continuously in a longitudinal direction and causing said contacts to be elastically deformed, and anchoring holes independent from one another each into which part of said pressure receiving portion can be inserted, and said pivoting member is mounted on the housing so that said urging portions are pivotally moved between said pressure receiving portions and the second pieces facing thereto of said contacts, and wherein when said urging portions are pivotally moved, a rotational axis of said urging portions is moved with their pivotal movement to perform a compact rotation, and when said actuating portion is pivotally moved in a direction at right angles to the direction of the fitting opening of said housing and away from the connection portions of said contacts so that the contact portions of said contacts are brought into contact with said connecting object.

25. The connector as set forth in claim 24, wherein as said holding means, at least every other contact is provided on said second piece with a raised portion extending toward said pressure receiving portion, while said pressure receiving portion of said first piece is provided with a protruded portion extending toward said raised portion so that said protruded portions and said raised portions are staggered relative to each other, thereby holding the urging portions of said pivoting member to permit their pivotal movement.

* * * * *